US008667938B2

(12) United States Patent
von Mayenburg

(10) Patent No.: US 8,667,938 B2
(45) Date of Patent: Mar. 11, 2014

(54) COMBUSTION ENGINE WITH VARIABLE VALVE ACTUATION

(76) Inventor: Michael von Mayenburg, Villach-Landskron (AT)

( * ) Notice: Subject to any disclaimer, the term of this patent is extended or adjusted under 35 U.S.C. 154(b) by 144 days.

(21) Appl. No.: 13/220,491

(22) Filed: Aug. 29, 2011

(65) Prior Publication Data

US 2012/0272931 A1 Nov. 1, 2012

Related U.S. Application Data

(60) Provisional application No. 61/481,074, filed on Apr. 29, 2011.

(51) Int. Cl.
*F01L 1/34* (2006.01)

(52) U.S. Cl.
USPC ..... 123/90.17; 123/90.15

(58) Field of Classification Search
USPC ..... 123/90.15, 90.16, 90.17, 90.6
See application file for complete search history.

(56) References Cited

U.S. PATENT DOCUMENTS 4,215,660 A 8/1980 Finley
5,404,770 A * 4/1995 Kruger ..... 74/568 R
7,946,260 B2 5/2011 von Mayenburg
2011/0023834 A1 2/2011 von Mayenburg
2011/0155106 A1 6/2011 von Mayenburg
2011/0192379 A1 8/2011 von Mayenburg
2012/0272931 A1 11/2012 Von Mayenburg

FOREIGN PATENT DOCUMENTS

DE 102006015887 A1 10/2007
WO WO2011/090590 A2 7/2011

* cited by examiner

*Primary Examiner* — Zelalem Eshete
(74) *Attorney, Agent, or Firm* — Klarquist Sparkman, LLP

(57) ABSTRACT

A valve actuating cam has a periphery that can be varied in shape to control the opening and closing of one or more valves associated with a cylinder of an internal combustion engine. One portion of a valve assembly can be moved outwardly to change the valve lift. A band can surround the movable cam portion and cam body portion, and can form at least a major portion of the exterior surface of the cam that engages a cam follower such as a valve operating rocker arm. The timing of the opening and closing of one or more valves can be adjusted by adjusting the peripheral shape of the cam. The shape can be adjusted to start a ramp portion of the cam peripheral surface earlier to cause a valve to open earlier and to end a ramp portion later to cause the valve to close later with a first load on the engine and to open and close earlier when the engine is under a second load that is less than the first load. Wedges and wedging surfaces under the band and movable with the movable portion of the cam can be used to adjust the timing.

43 Claims, 20 Drawing Sheets

COMBUSTION ENGINE WITH VARIABLE VALVE ACTUATION

CROSS REFERENCE TO RELATED APPLICATION

This application claims the benefit of U.S. Provisional Application Ser. No. 61/481,074, entitled COMBUSTION ENGINE WITH VARIABLE VALVE ACTUATION, filed on Apr. 29, 2011, which is incorporated by reference herein.

TECHNICAL FIELD

The disclosure herein relates to an internal combustion engine with cylinders having one or more exhaust valves and intake valves whose operation can be varied and to mechanisms for and methods of varying the valve actuation.

BACKGROUND

In one common approach for opening and closing a valve that controls an opening that communicates with a combustion cylinder of an internal combustion engine, a rocker arm coupled to the valve is pivoted to control the opening and closing of the valve. A valve actuating cam is mounted to a rotating valve cam supporting shaft to engage the rocker arm as the cam shaft is rotated to control the opening and closing of the valve.

An exemplary known valve actuating cam 10 is shown in FIG. 1. Cam 10 has a cross-sectional shape as shown in FIG. 1 that is bounded by a fixed sized and shaped perimeter 12. The illustrated cam 10 has a vertical center line 14 and horizontal center line 16 that intersect at a point 18. The cam includes a base circuit portion consisting of an arc of a circle having a radius 22 from center 18 and as also indicated as R/BC in FIG. 1. The base circuit includes a first base circuit portion 24, from point 1 to point 2 along the cam periphery. Point 1 is located at the intersection of vertical center line 14 and the periphery 12 of the cam at the lower most point shown in FIG. 1. Point 2 is located at a location that is clockwise from point 1 on the cam periphery. The base circuit has a constant radius between these two points 1, 2. The periphery 12 of the cam includes a ramp portion 28 from point 2, in the clockwise direction along the periphery, to a point 3. A radius line 34 indicates the radius R/R of the ramp portion at one location along the arc of the ramp portion between points 2 and 3. The radius R/R is from point R to the periphery. At point 2, the cam shifts the rocker arm to begin to open the valve with a steady increasing acceleration. The cam periphery also includes a flank portion 40 from point 3 to a point 4 in a clockwise direction along the periphery 12 of the cam. At point 3 there is a further increase of the acceleration of the cam follower and therefore of the valve opening. At point 4, the flank portion ends and a first cam top portion 42 begins. The cam top portion extends along the periphery of the cam in a clockwise direction from point 4 to point 5. The illustrated cam top has a constant radius 46 (also designated R/T) from a center point 48 to the periphery 12 of the cam 10. At point 4, where the cam top begins, the acceleration of the valve opening starts to decrease. At point 5, the top of the cam, the acceleration is zero and the valve lift has reached its maximum. Thus, the valve is opened as the contact between the cam and cam following rocker arm moves from point 1 to point 5 due to the rotation of the cam. As the cam moves from point 5 to point 1 the valve is closed. Although the left and right side peripheries of the cam shown in FIG. 1 are mirror images of one another, these cam sections do not need to be symmetrical, which means that different accelerations can be achieved as the valve is opened in comparison to the accelerations as the valve is closed. Moving in a clockwise direction in FIG. 1 from point 5, a second top portion 42' is provided from point 5 to a point 4'. Also, a second flank portion 40' is shown between points 4' and a point 3'. In addition, a second ramp portion 28' is shown between a point 3' and a point 2'. Finally, a second base circuit portion 24' is shown between the point 2' and the point 1. The ' (prime) designations have been used to indicate the correspondence between the respective portions of the periphery of the illustrated cam at the right side and left side of the cam.

To avoid acceleration spikes, the ramp portion 28 can start at point 2 along a line that is tangential to the base circuit radius R/BC. In addition, the flank portion 40 can start at point 3 along a line that is tangential to the ramp circuit radius R/R. Also, the top portion 44 can start at point 4 along the line that is tangential to the flank radius R/F at this location.

It is common for three different fixed shapes of a flank portion (points 3 to 4 and 4' to 3') to be used for fixed perimeter cams depending upon the cam follower design, the chosen acceleration limit and valve lift achieved by the fixed perimeter cam. In FIG. 1, these three shapes are shown. The most common shape is the flank R/F being of a convex shape as indicated by the radius "R/F convex" and designated by the number 52. If the radius R/F is in effect infinite (see radii 54, 57), the flank is flat as indicated by the dashed line 56 from locations 3" to 4". In some cases the flank is designed by selecting a radius R/F to achieve a concave flank, such as indicated by the radius R/F', and designated by the number 60, at a location of the flank 40' from location 4' to location 3' at the right side of the cam shown in FIG. 1.

Engines that use cams of a fixed peripheral shape suffer from reduced efficiency (specifically in the case of gasoline engines) and increased emissions (e.g., $CO_2$ and NOx emissions). That is, the cam shape is typically optimized for a specified engine speed and load, which leads to inefficiencies as the engine is operated under conditions that are different from the optimized conditions for which the cam shape was designed. For gasoline engines, the load is governed by the combustion air/fuel mixture allowed to enter the cylinder (sucked in or being pressed in with turbocharged engines) during the intake stroke. Consequently, for gasoline engines with cams of a fixed peripheral shape, the engine air inlets are throttled, for example, by a butterfly valve, which closes at idle. In this case, the energy required to introduce the combustion air into a combustion chamber of a cylinder and to exhaust burned gases from the chamber is wasted and reduces the fuel efficiency of the gasoline engine. Consequently, it would be desirable to eliminate such an inlet throttle. To address such issues, attempts have been made to develop gasoline and diesel engines with variable valve actuation. However, variable valve actuated combustion engines known to the inventor are of high complexity, require large space, and are heavier and exhibit significantly higher drag than the non-variable valve actuated engines using a cam of a fixed perimeter such as shown in FIG. 1. The higher drag reduces the achievable efficiency gains.

Therefore, a need exists for an internal combustion engine with improved variable valve actuation as well as for improved components of such a system and related methods.

SUMMARY

In accordance with one aspect of an embodiment disclosed herein, a valve actuating cam has a periphery that can be varied in shape to control the opening and closing of one or more valves associated with a cylinder of an internal combustion engine.

This variable valve actuating cam can be used in diesel or gasoline fueled engines to increase their efficiency. In the case of a gasoline engine, throttling of inlet air to the engine can be eliminated. In accordance with one aspect of an embodiment, one portion of a cam assembly can be moved outwardly or inwardly to change the valve lift. This outward movement can be accomplished, for example, by an eccentric that engages a movable portion of the cam assembly such that pivoting of the eccentric in one direction pushes the movable portion outwardly. This inward movement can be accomplished by pivoting the eccentric in a direction opposite to said one direction to allow the retraction of the movable portion inwardly relative to a cam body portion. Alternatively, axial movement of a wedge coupled to the movable portion of the cam can adjust the outward and inward position of the movable portion to adjust the valve lift. Desirably, the movable portion of the cam comprises a top portion of the cam. In one form, the top portion that is movable includes a portion of the cam periphery including a cam top and at least portions of the cam flanks on either side of the cam top.

In accordance with another aspect of an embodiment, a cam assembly comprises a surround, such as a band that surrounds a movable cam portion and a cam body and that accommodates the motion of the movable cam portion. The band desirably comprises at least a major portion of the exterior surface of the cam. The exterior surface of the cam is rotated in contact with a valve actuating cam roller to control the position of the cam follower, such as a valve operating rocker arm.

In accordance with an embodiment, the timing of the opening and closing of one or more valves can be adjusted by adjusting the peripheral shape of the cam. The shape can be adjusted to start a ramp portion of the cam peripheral surface to cause a valve to open earlier and to close later at a first engine load and to open later and close earlier at a second engine load that is less than the first engine load. A timing adjustment mechanism can be used that starts the ramp portion on the valve opening surface of the cam earlier to cause earlier opening of the valve under heavier engine load conditions in comparison to the start of the ramp under lighter engine load conditions; and to also adjust the ramp on the valve closing surface of the cam to cause later closing of the valve later under heavier engine load conditions than the case of lighter engine load conditions.

As an aspect of this embodiment, the timing can be selectively varied by adjusting the shape of the periphery of the cam. As a more specific aspect of this embodiment, a wedge mechanism can comprise at least one first wedge on one side of a center of the cam and at least one second wedge on the opposite side of the center of the cam. The first and second wedges can each engage a respective wedging surface of the cam body as the cam top portion is moved outwardly such that the wedging surfaces each urge their respective engaged wedge outwardly and consequently press or urge a surrounding band outwardly to change the shape of the periphery of the cam. Desirably the wedging surfaces are curved in a convex manner. In one desirable form, the contact surfaces of the wedge on the cam body are of a spiral configuration. In accordance with an aspect of a more specific embodiment, one set of first and second wedges and associated wedging surfaces can be provided at one side or front of the cam top portion and another set of first and second wedges and associated wedging surfaces can be provided at the other side or back of the cam top portion. A cam peripheral member that accommodates the movement of the cam top portion is desirably provided and can surround the cam body, cam top portion, and wedges. This cam peripheral member can be a band, such as a steel band that is under a spring load and is configured to expand in length to accommodate the outward movement of the cam adjustment portion and to bias or to urge the cam adjustment portion toward an inward position. The cam peripheral member, such as comprising a spring band, is configured to contract in length to accommodate the inward movement of the cam adjustment portion.

In accordance with more specific aspects of an exemplary embodiment, an apparatus for opening and closing one or more cylinder valves of an internal combustion engine comprises a valve actuating shaft having a longitudinal shaft axis; at least one cam assembly positioned along the length of the shaft such that rotation of the shaft about the shaft axis rotates the cam assembly, the cam assembly comprising a cam body portion and a cam adjustment portion, the cam adjustment portion being coupled to the cam body portion for movement in a first direction outwardly from the cam body portion to increase the distance around the cam body portion and cam adjustment portion and for movement in a second direction inwardly toward the cam body to reduce the distance around the cam body portion and cam adjustment portion; a cam actuator coupled to the cam adjustment portion and positioned within the valve actuating shaft, the cam actuator being operable such that movement of the cam actuator in one direction moves the cam adjustment portion in the first direction and movement of the cam actuator in another direction allows the movement of the cam adjustment portion in the second direction; the cam assembly comprising a band comprising a spring portion that is of expandable and retractable length surrounding the cam body portion and cam adjustment portion, the spring portion of the band expanding in length in response to the movement of the cam adjustment portion in the first direction and contracting in length in response to the movement of the cam adjustment portion in the second direction; the cam body portion further comprising at least first and second wedging surfaces that at least partially underlay and face the band, the first wedging surface leading in the direction of rotation of the cam assembly and the second wedging surface lagging in the direction of rotation of the cam assembly; the cam assembly comprising a first wedge coupled to the cam adjustment portion and positioned at least partially between the first wedging surface and the band, the cam assembly also comprising a second wedge coupled to the cam adjustment portion and positioned at least partially between the second wedge surface and the band, the first and second wedges being movable with the movement of the cam adjustment portion in the first and second directions; the first wedge and first wedging surface and the second wedge and second wedging surface being configured to adjust the shape of the band to cause the opening of the valve to commence earlier in the rotational position of the cam assembly with the movement of the cam adjustment portion in the first direction and to cause the opening of the one or more valves to commence later in the rotational position of the cam assembly with the movement of the cam adjustment portion in the second direction; and a valve actuator coupled to the cam assembly and operable to open and close one or more cylinder valves as the cam assembly rotates.

In accordance with another aspect of an embodiment, the cam adjustment portion can comprise an arcuate band engaging exterior surface positioned to engage the band and a projecting member extending in a direction away from the band engaging exterior surface, the cam body portion defining a projecting member receiving opening that slidably receives the projecting member, the projecting member being coupled to the cam actuator, wherein movement of the cam actuator in said one direction applies an outward force to the projecting member to urge the cam adjustment portion and thereby the band engaging exterior surface in the first direction; and movement of the cam actuator in said another direction allows the spring band to contract to urge the cam adjustment portion and thereby the band engaging exterior surface in the second direction.

In accordance with a further aspect of an embodiment, the cam actuator can comprise an eccentric positioned within the valve actuator shaft to engage the cam adjustment portion to move the cam adjustment portion in the first direction upon rotation of the eccentric in one rotational direction and to allow movement of the cam adjustment portion in the second direction upon rotation of the eccentric portion in a rotational direction opposite to said one direction. In an alternative embodiment, the cam actuator can comprise a camming wedge movable axially within the valve actuating shaft, the camming wedge being coupled to the cam adjustment portion such that sliding of the camming wedge axially in one wedge sliding direction causes the cam adjustment portion to move in the first direction and sliding the wedge axially in a direction opposite to said one wedge sliding direction allows the cam adjustment portion to move in the second direction.

As yet other aspects of embodiments, the spring portion of the band can apply a retraction force to the exterior surface of the cam adjustment portion to urge the cam adjustment portion in the second direction. Also, the cam adjustment portion can comprise a recess that opens toward the band and the band can have a band projection shaped and positioned within the recess. In one specific form, the band can have one or more spring configured first and second band end portions and a central band portion and the central band portion can be thicker than the thickness of the first and second band end portions. In one embodiment, the spring portion can be detachable from a body portion of the band.

In addition, the band can comprise a body with first and second distal end portions. The first and second distal end portions of the body can be configured to engage one another to hold the distal end portions of the band together. The band can comprise at least one serpentine band section that expands with the movement of the cam adjustment portion in the first direction and contracts with the movement of the cam adjustment portion in the second direction. In a more specific exemplary form, the band can comprise first and second serpentine end portions and a central portion or one or more detachable serpentine portions. The serpentine portions can comprise the spring portions of the band. The band can comprise a band projection extending inwardly toward the cam adjustment surface. The cam adjustment surface can comprise a recess configured and positioned to receive the spring band projection.

Aspects of embodiments of a wedging mechanism can comprise one or more wedges that are generally elongated and arcuate in shape. As an alternative, in cross-section, each of the wedges can comprise a tip portion positioned adjacent to a cam adjustment portion that is of an acute shape and a base portion spaced from the cam adjustment portion that is of a rounded shape. In one embodiment, upon movement of the cam adjustment surface in the second direction to its furthest retracted position, a first gap can be provided between a first wedge and a first wedging surface and a second gap can be provided between a second wedge and a second wedging surface, the first and second gaps can be positioned adjacent to the base portion of the respective first and second wedges. In addition, movement of the cam adjustment portion in the first direction causes the first wedging surface to push the first wedge outwardly to push a band outwardly and also causes the second wedging surface to push the second wedge outwardly to push the band outwardly. As a result, the timing of the commencement of the opening and closing of the valve is changed. In one desirable form, the first and second wedging surfaces are curved. More specifically, in a particularly desirable form, the first and second wedging surfaces can comprise respective surface portions that are of a spiral configuration. The wedging surfaces can, but do not need to, define the same wedging angle. For example, the wedging angle of the leading side of the cam assembly can be greater than the wedging angle at the trailing side such that the valve is lifted more rapidly than it closes as the cam assembly rotates (see FIG. 13 for an exemplary valve).

In accordance with an embodiment, there can be two first wedge surfaces with one of the first wedge surfaces being positioned axially along the valve actuating shaft adjacent to one side of the cam adjustment portion and the other of the first wedge surfaces being positioned axially along the valve actuating shaft adjacent to the other side of the cam adjustment portion. In addition, there can be two second wedge surfaces with one of the second wedge surfaces being positioned along the valve actuating shaft adjacent to one side of the cam adjustment portion and the other of the second wedge surfaces being positioned axially along the valve actuating shaft adjacent to the other side of the cam adjustment portion. The apparatus can also comprise a wedge assembly comprising a wedge base comprising first and second side edge portions, a first set of wedges comprising one first wedge and one second wedge being mounted to the wedge base along the first side edge portion of the wedge base, and a second set of wedges comprising another first wedge and another second wedge mounted to the wedge base along the second side edge portion of the wedge base. The wedge assembly can be positioned such that the first set of first and second wedges are positioned to face the respective first and second wedge surfaces adjacent to said one side of the cam adjustment portion and the second set of the first and second wedges are positioned to face the first and second wedge surfaces and are adjacent to said other side of the cam adjustment portion. The base of the wedge assembly can comprise a central portion positioned at least partially between the band and the cam adjustment portion.

In accordance with an aspect of an embodiment, the cam adjustment portion can comprise a cam adjustment portion recess facing the band and extending across the cam adjustment portion in a direction parallel to the shaft axis. Also, the wedge base can comprise a wedge assembly projection sized and positioned to fit within the cam adjustment portion recess. The wedge base can comprise a wedge assembly recess facing the band and extending in a direction parallel to the shaft axis. In addition, the spring band can comprise an interior band projection positioned, sized and configured to fit within the wedge assembly recess.

In accordance with yet another aspect of an embodiment, a valve actuator can comprise a rocker arm coupled to a valve and the cam assembly can be positioned to engage the rocker arm such that the cam assembly shifts the rocker arm to open and close the valve as the cam assembly is rotated. In addition, the selective variation of the shape of the periphery of the cam assembly in one embodiment changes at least the lift of the valve and in another embodiment the timing can also be changed. In an alternative form, the valve actuator can comprise first and second rocker arms with first and second valves associated with a cylinder and with each valve being operably coupled to a respective one of the rocker arms. A roller can extend between said first and second rocker arms. The cam assembly can be positioned to engage the roller such that as the cam assembly rotates, the first and second rocker arms simultaneously operate the first and second valves. As a further alternative, a pin can be coupled to the first and second rocker arms so as to define a pin axis. A bearing, such as a needle bearing, can be supported by the pin with the roller being rotatably coupled by the bearing to the pin for rotation about the pin axis. As yet another alternative, the roller can comprise respective first and second end portions. A first bearing, such as a needle bearing, can couple the first end portion of the roller to the first rocker arm and a second bearing, such as a needle bearing, can couple the second end portion of the roller to the second rocker arm. In addition, the roller can be rotatable relative to the rocker arms.

In an embodiment in which the valve lift is adjustable but not the valve timing, the wedge mechanism for adjusting timing can be eliminated.

In accordance with one aspect of a method of opening and closing a cylinder valve of an internal combustion engine disclosed herein, the method comprises adjusting the exterior shape of a valve actuating cam to cause the timing of the opening of a valve to commence earlier and closing of a valve to commence later in response to the engine operating at a first engine speed, or first load; and adjusting the exterior shape of the valve actuating cam to cause the timing of the opening of the valve to commence later and the closing of the valve to commence earlier in response to the engine being operated at a second engine speed or load that is less than the first engine speed or first load.

As another aspect of a method, the act of adjusting the exterior shape in response to the engine being under the first load can comprise expanding the exterior dimension of one portion of the cam in a first direction and the act of adjusting the exterior shape in response to the engine being under the second load comprising contracting the exterior dimension of said one portion of the cam.

These and other aspects of embodiments of the invention disclosed herein will become more apparent with reference to the following description and drawings.

DETAILED DESCRIPTION

Throughout this disclosure, when a reference is made to a first element being coupled to a second element, the term "coupled" is to be construed to mean both direct connection of the elements as well as indirect connection of the elements by way of one or more additional intervening elements. Also, the singular terms "a", "and", and "first", mean both the singular and the plural unless the term is qualified to expressly indicate that it only refers to a singular element, such as by using the phase "only one". Thus, for example, if two of a particular element are present, there is also "a" or "an" of such element that is present. In addition, the term "and/or" when used in this document is to be construed to include the conjunctive "and", the disjunctive "or", and both "and" and "or". Also, the term includes has the same meaning as comprises.

In addition, terms such as lower, upper, side, front and back are used for convenience to refer to portions of embodiments in positions shown in illustrations. These terms are not to be construed as limiting unless indicated by the context. For example, a cam member with a "top" portion when rotated 180 degrees would then have the "top" portion at a low position. However, the portion is still a "top" portion as only the orientation has changed.

Figure 2A:
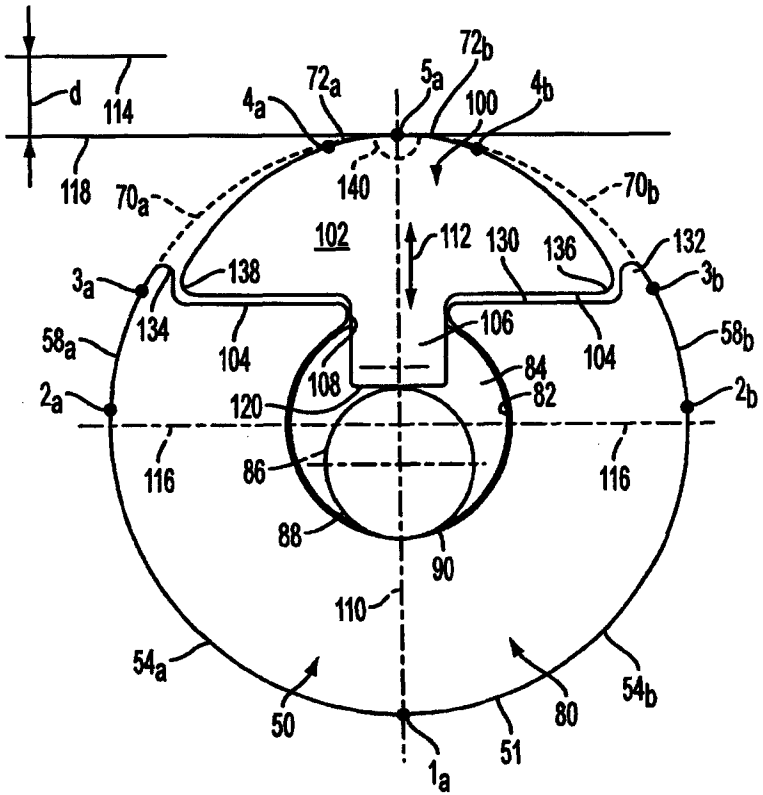
FIG. 2A is a view of an embodiment of FIG. 2 with the cam adjustment portion shown in a fully collapsed position.
Figure 2:
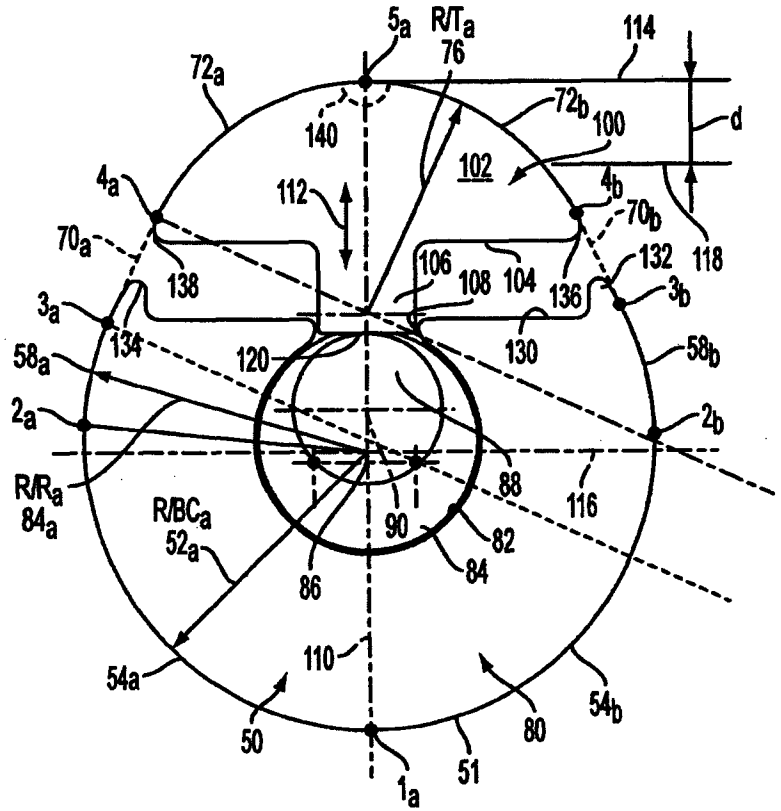
FIG. 2 is an end view of a portion of an embodiment of a cam assembly comprising a cam body portion and a cam adjustment or lift portion with the lift portion shown in a full lift position.
Figure 2B:
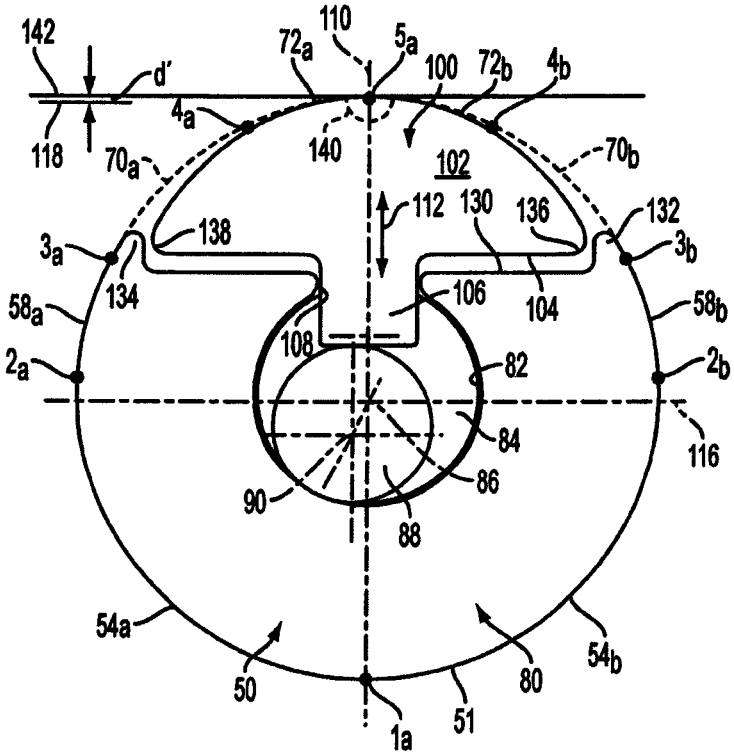
FIG. 2B is a view of the embodiment of FIG. 2 with the cam adjustment portion shown in a slightly raised or engine idle position.

With reference to FIGS. 2, 2A and 2B, an exemplary embodiment of a cam assembly (a portion of which is shown in these figures) is illustrated for use in controlling the opening and closing of one or more valves associated with a cylinder of an internal combustion engine. The illustrated cam assembly 50 comprises a cam body portion 80 having an opening 82 that extends through the cam body portion from front to back thereof. A valve actuating shaft 84 extends through the opening 82. For convenience a small gap is shown between the exterior surface of the shaft 84 and the surface bounding opening 82. However, desirably these surfaces abut one another if no bushing is included therebetween. The center of the longitudinal axis of the opening 82 and of the shaft 84 is shown at 86 in these figures. The assembly also comprises an eccentric portion or eccentric 88 that can comprise a portion of the actuating shaft 84 and that can be of circular or other cross-sectional shape. The center of the eccentric portion is indicated at 90 in these figures. Rotation of the eccentric portion 88 relative to the cam body portion 80 shifts the center 90 of the eccentric portion 88 relative to the center 86 of the shaft 84 for purposes that will become apparent from the description below. An example of this relative rotation of the eccentric can be seen by comparing the position of the eccentric portion 88 in FIG. 2 with the position of the eccentric portion 88 shown in FIG. 2A.

The cam assembly 50 also comprises a movable cam adjustment portion 100 that can be moved relative to the cam body portion 80 to change the shape of the periphery 51 of the cam assembly. The cam adjustment portion 100 can be of any suitable shape. In the embodiment shown in FIGS. 2, 2A and 2B, the cam adjustment portion 100 comprises a cam top portion 102 having an arcuate and, in one form, a desirably circular shaped upper surface. The illustrated cam top 102 comprises a base 104 and a stem or projecting portion 106 that extends from base 104 in a direction toward the cam body. A stem receiving or projection receiving slot opening 108 communicates with the interior of the cam body 80 and more specifically with the opening defined in surface 82 of the cam body. The projection 106 is oriented to slide along a vertical center line 110 that extends through the cam assembly of FIG. 2 both toward and away from the cam body in directions indicated by double headed arrow 112.

In the embodiment shown in FIG. 2, the cam top portion 102 is configured to slide radially away from and radially toward the center 86 of the shaft 84. A comparison of FIGS. 2 and 2A illustrates the movement of the top location 5*a* of the cam top portion 102 relative to the cam body portion 80 from a first position tangential to a line 114 parallel to a horizontal line 116 (perpendicular to line 110) and extending through the center 86 of the shaft 84 to a second position. In the second position, the top 5*a* of the cam top portion 102 is tangential to a line 118 that is parallel to the line 116 and spaced from the line 114 by distance d.

The stem or projection 106 can have a base surface 120 coupled to the eccentric portion 88, such as abutting a stem facing portion of the eccentric. The surface 120 can face the opening 108 such that movement of the eccentric 90 in a counter-clockwise direction from the position shown in FIG. 2 to the position shown in FIG. 2A allows the stem portion 106 to retreat further into the slot or opening 108. When this happens, the periphery 51 of the cam assembly is reduced or contracted in length. In contrast, a movement of the eccentric portion 88 in the clockwise direction, from the position shown in FIG. 2A to the position shown in FIG. 2, moves the cam adjustment portion 100, in this example the cam top 102, outwardly and expands or lengthens the periphery 51 of the cam assembly.

In the embodiment shown in FIGS. 2, 2A, and 2B, the cam body portion 80 defines an upper recessed shelf 130 bounded on opposite ends by projections or flange portions 132, 134.

When the cam top portion 102 is collapsed into the cam body portion 80, the base 104 of the cam top portion 102 is positioned adjacent to the shelf 130 (as shown in FIG. 2A) and can, but desirably does not, abut the shelf. In addition, side edges 136, 138 of cam top portion 102 can be nested within the recess between projections 132, 134 with the side edges 136, 138 being positioned below the distal ends of the respective projections 132, 134.

Figure 1:
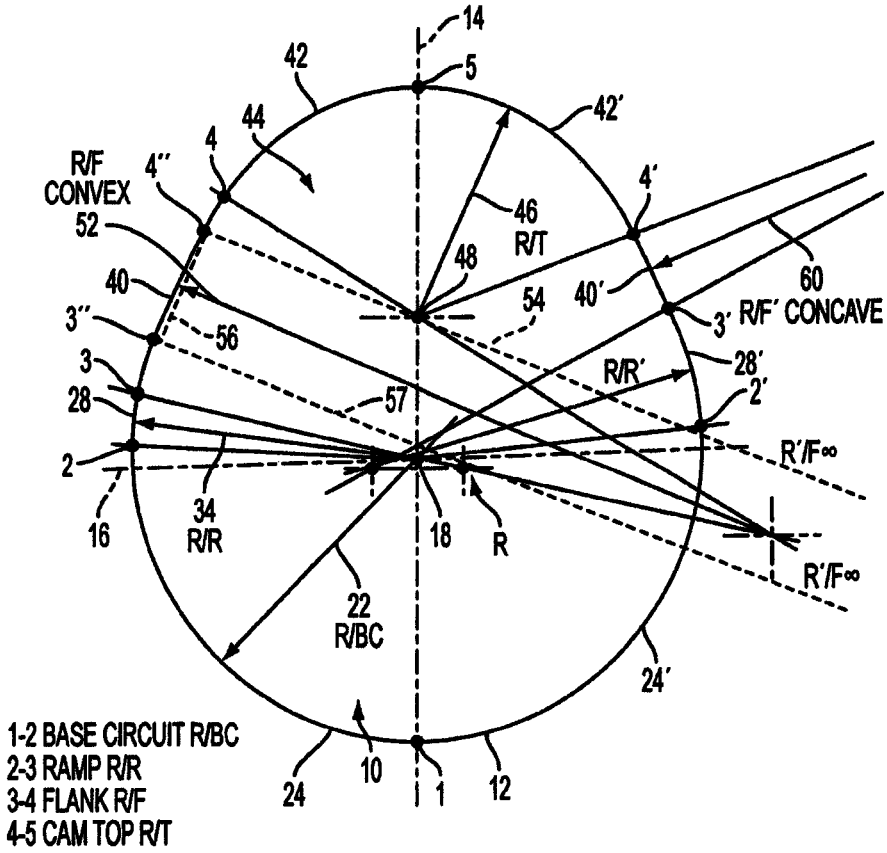
FIG. 1 PRIOR ART
FIG. 1 is a schematic illustration of a prior art valve actuating cam of a fixed peripheral shape.

With reference to FIG. 2, the position of cam adjustment portion 100, in this example the cam top portion 102, relative to cam body portion 80 corresponds to a full valve lift position of the cam assembly. When configured as shown in FIG. 2, the cam body portion 80 comprises a first base circuit portion 54*a* having a radius 52*a* corresponding to the radius R/BCa shown in this figure. This radius can be the same as the radius 22 shown in FIG. 1. Although, not shown in FIG. 2, 2A or 2B, and as will be apparent from the description of an embodiment below, a surround such as a band is desirably provided around the periphery of the cam base portion 80 and cam adjustment portion 100 so as to desirably overlie any gap between these components. In this case, the radius R/BCa can also include the thickness of the surround. The first base circuit portion 54*a* of the base circuit extends from location 1*a* to location 2*a*. At location 2*a*, a ramp portion of the cam assembly commences with the ramp portion extending from location 2*a* to location 3*a*. A radius 84*a* (R/Ra) is shown at one location between the points 2*a* and 3*a*. In one embodiment, the radius 84*a* can be equal to the radius 52*a*, in which case lifting of a valve coupled to the cam assembly of FIG. 2 would not commence at location 2*a*. Alternatively, radius 84*a* can be greater than radius 52*a* so that a ramp similar to the ramp shown in FIG. 1 is provided between location 2*a* and location 3*a* along the periphery of the cam assembly. In FIG. 2, a flank portion of the cam periphery, indicated at 70*a*, is provided between location 3*a* and location 4*a*. By configuring the shapes of the projection 134 and end portion 138 (and similarly the shape of the projection 132 and the end portion 136 at the opposite side of the cam assembly), a flat flank can be provided. When a cam roller engages the area from 3*a* to 4*a*, in the case of a surrounding band engaged by the roller, the band can assume a concave shape between locations 3*a* and 4*a* due to the load of the cam roller. A top circuit portion 72*a* is also shown in FIG. 2 between locations 4*a* and 5*a*. Another respective top circuit portion 72*b*, flank portion 70*b*, ramp portion 58*b* and base circuit portion 54*a* is also shown in the FIG. 2 embodiment between points 5*a* and 1*a* at the right side of the cam assembly shown in this figure. As is previously explained, although the cam assembly shown in FIG. 2 is symmetric about the vertical axis 110, the cam assembly can be configured to have a periphery that is not symmetric with the right side periphery of the cam having a different shape than the left side periphery of the. A recess 140, that can comprise a longitudinally extending groove in the cam top portion 102, can also be provided for reasons explained below. Desirably the groove 140 extends from front to back of the cam top portion 102, but the recess, if provided, can assume other shapes.

In the position shown in FIG. 2A, the periphery about the entire cam assembly, if circular, would provide no valve lift and the engine would not run.

In the position shown in FIG. 2B, the eccentric portion 88 has been shifted to move the cam top portion 102 outwardly in comparison to FIG. 2A from a position aligned with the line 118 in FIG. 2A to a position aligned with a line 142 in FIG. 2B. The lines 114, 118 and 142 in FIGS. 2, 2A and 2B are parallel to the line 116. In this case, which corresponds to an idle engine valve position, the flanks 70*a* and 70*b* are no longer circular so that some valve lift occurs and the engine can run in idle.

It should be noted that in the embodiment of FIGS. 2A, 2B and 2C the ramp portion between locations 2*a* and 3*a* can be other than circular so that movement of the valve (e.g., lift) occurs between locations 2*a* and 3*a* and some closing of the valve occurs between locations 3*b* and 2*b*. In addition, due to the lift that occurs along the flank portion 70*a* between locations 3*a* and 4*a* of FIG. 2 (and the smaller lift that occurs between points 3*a* and 4*a* along flank 70*a* of FIG. 2*b*, further control of the valve operation is achieved. The eccentric portion 88 can be selectively pivoted (such as using a hydraulic or electric motor, such as a stepper motor, with feedback) to control the movement of the cam adjustment portion 100 and thereby the periphery of the cam and the operation of the valve as an engine is operated. This control can be, for example, based upon engine torque and/or engine speed.

Figure 3:
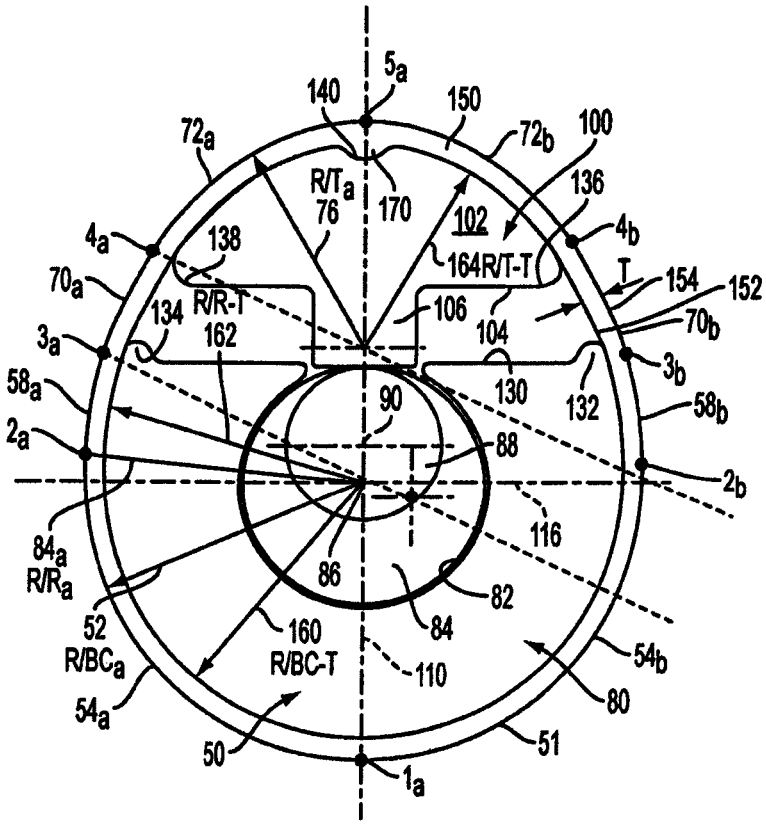
FIG. 3 is an end view of the cam assembly of the embodiment of FIG. 2 with a peripheral band in place.

FIG. 3 illustrates a cam assembly like that shown in FIG. 2, but with a surround 150 added to the cam assembly to complete the assembly. The illustrated surround 150 comprises a peripheral band comprising one or more expandable spring portions. In the embodiment of FIG. 3, the band has a thickness T that, in this one embodiment, can be uniform. In this embodiment the expandable spring portions comprise expandable portions at the respective ends of a body portion of the band that are each in the form of a spring. The band 150 has an interior surface 152 and an exterior surface 154. The exterior surface 154 comprises at least a portion of and desirably substantially the entire periphery 51 and/or the entire periphery of the cam assembly 50.

The cam assembly in FIG. 3 is shown in the same position as shown in FIG. 2. In the embodiment of FIG. 3, the radius 52 includes the thickness of the surround. In addition, the radius 84*a* (R/Ra) includes the thickness of the surround as does the radius 76 (R/Ta). Radiuses 160 (R/BCT-T); 162 (R/R-T) and 164 (R/T-T) are also shown in the figure and correspond to the radii along selected portions of the cam minus the thickness T of the surround. The illustrated surround can also include an interior projection 170, such as a longitudinally extending ridge, that can extend from front to back of the cam assembly, positioned within the recess 140 to secure the surround against movement relative to the cam body portion 80 and cam top portion 102. The recess 140 can be of any desired shape with the projection 170 being of a corresponding shape such that the projection and recess interfit with one another. Alternatively, the surround can include the recess and the cam adjustment portion can include a projection for interfitting with the recess. Other alternative mechanisms for preventing relative rotation between the surround and cam portions can be used. For example, these components can be fastened together at one location.

The surround for the cam body portion 80 and cam top portion 102 is capable of elongation in length to accommodate the movement of the cam adjustment portion away from cam body portion and to contract in length to accommodate the movement of the cam adjustment portion toward the cam body portion. Desirably the surround applies a biasing force that resists the outward movement of the cam adjustment portion. In one specifically desirable form, the surround comprises a spring band. The spring band can be comprised of an inelastic material such as spring steel comprising a spring portion that permits stretching of the band. Although variable, an exemplary band thickness would be between 1.5 mm and 2.5 mm. The central portion of the band body can be heat treated to resist wear by a cam roller and the spring portion or portions can be heat treated to provide a desirable spring function. In one specific example, the band comprises and/or consists of a metal, such as spring steel, with one or more spring portions that are mechanically configured (for example by providing cut outs or void areas) to allow elongation of the band with the expansion or outward movement of the cam adjustment portion and contraction of the band with the inward movement of the cam adjustment portion.

With reference to FIG. 3, the surround such as a band is desirably non-expandable from location 2*a* to location 5*a* and from location 5*a* to location 2*b*. From location 2*b* to location 1*a* and from location 1*a* to location 2*a*, there band can be positioned in a groove inside (radially inwardly) of the R/BCa contour with the associated cam roller running on the R/BCa contour and not on the band (see e.g., FIG. 13A). The band spring portion(s) can be located between locations 2*b* to la and la to 2*a* so that the associated cam roller does not bear against the spring portions as the cam roller rotates.

Figure 4:
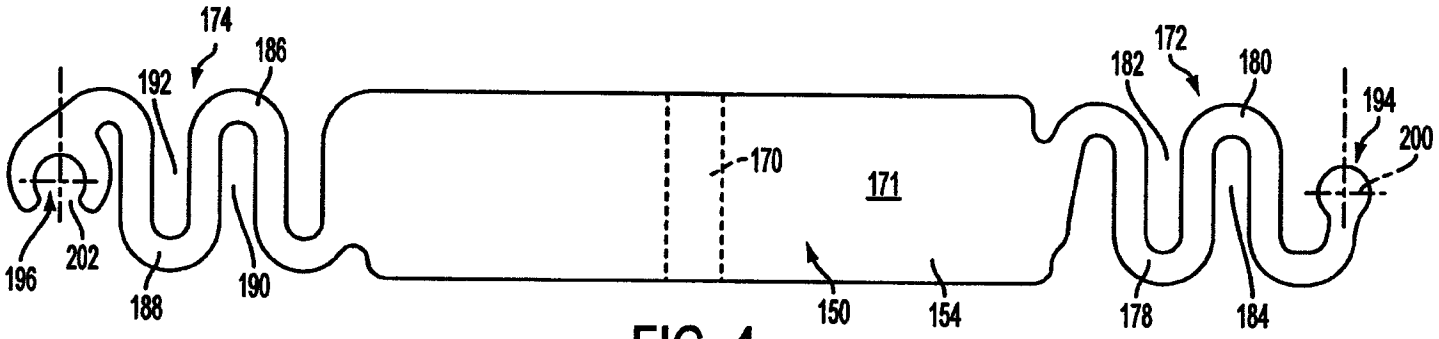
FIG. 4 is a top plan view of one form of a band comprising spring portions and that is usable in the cam assembly with the band shown flat.
Figure 4A:
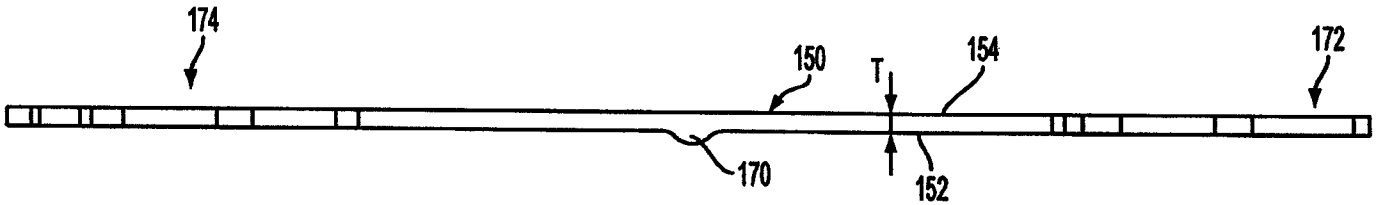
FIG. 4A is a side elevational view of the band of FIG. 4.

With reference to FIG. 4, one exemplary band 150 is shown in this figure and comprises a band body portion 171 with first and second distal end portions 172, 174 in the geometric shape or configuration of a spring. Desirably the band body comprises at least one spring portion and, in the embodiment of FIG. 4, each of the distal end portions 172, 174 comprises a spring portion. The body portion and one or more spring portions can be of one-piece construction. In FIG. 4, the spring portions extend outward from respective end portions of the body portion. More specifically, distal end portion 172 comprises a serpentine section having plural loops such as 178, 180 with respective gaps or voids 182, 184 between the loops. The end portion 174 also, in this example, comprises a serpentine portion having respective loops 186, 188 with gaps or voids 190, 192 therebetween. In addition, the respective end 194 of end portion 172 and end 196 of end portion 174 include mating features that engage one another when the band is wrapped around the cam adjustment portion and cam body portion to hold these ends together and thereby maintain the band in place. In the example shown in FIG. 4, end portion 194 comprises a circular insert portion 200 and end portion 196 comprises a generally circular opening 202. Insert portion 200 can be positioned within recess or opening 202 with these mating components creating an interference fit that holds the band together in an annular shape. Other alternative mating components can be used to hold the band in a loop. Desirably a connection mechanism is used that allows detachable interconnection of end portions of the band or other surround so as to allow removal of the surround if desired. However, and less desirably, the end portions can be welded or otherwise permanently secured together as an alternative construction. FIG. 4 and FIG. 4A also illustrate an exemplary projection 170 included in the band, such as at a central or intermediate portion of the body of the band for positioning in the recess 140 of the cam top portion 102 (see FIG. 3).

Figure 4B:
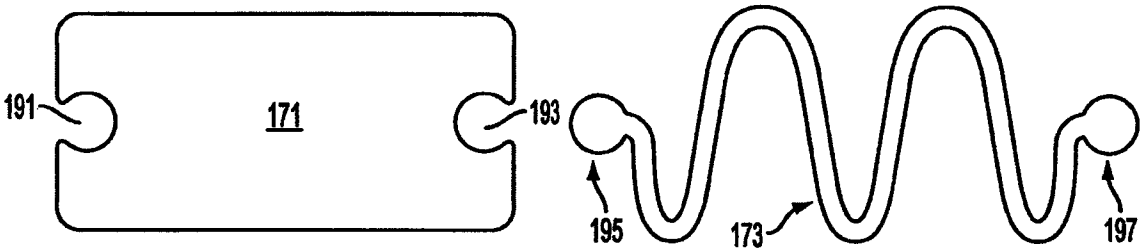
FIG. 4B is a top plan view of another form of band usable in the cam assembly comprising a detachable spring portion.
Figure 4C:
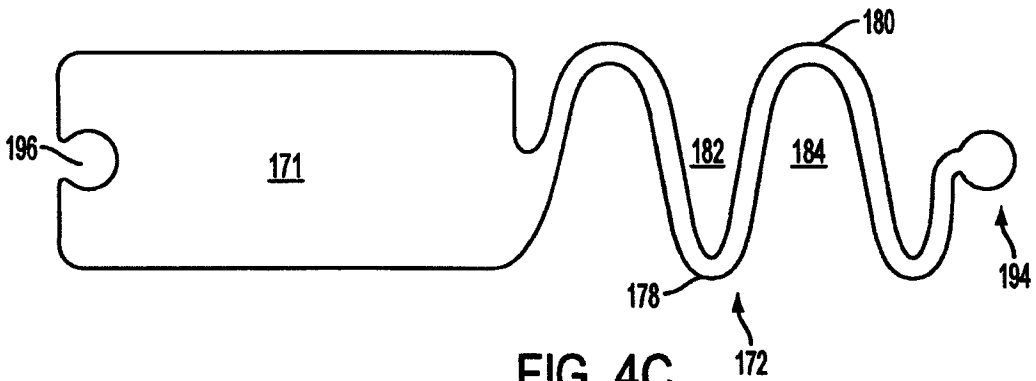
FIG. 4C is a top plan view of a further form of band usable in the cam assembly comprising a spring portion integrated with one end portion of a body of the band.

In the embodiment of FIG. 4C, only distal end portion 172 comprises a spring portion. The length of the body 171 and spring portion 172 can be the same length as the length of the body 171 and spring portions 172 and 174 in FIG. 4. In FIG. 4C, the mating portion 194 is shaped to mate with a recess 196 provided in the end of the body opposite to the end from which the spring portion 172 projects. In the FIG. 4B example, the body 171 comprises respective mating recesses 191, 193 at the opposite ends and the spring portion comprises a detachable spring portion 173 comprising a mating end 195 that is configured to mate with the recess 193 and a mating end 197 configured to mate with recess 191 to assemble the band in place around the cam body and cam adjustment portion.

Figure 5:
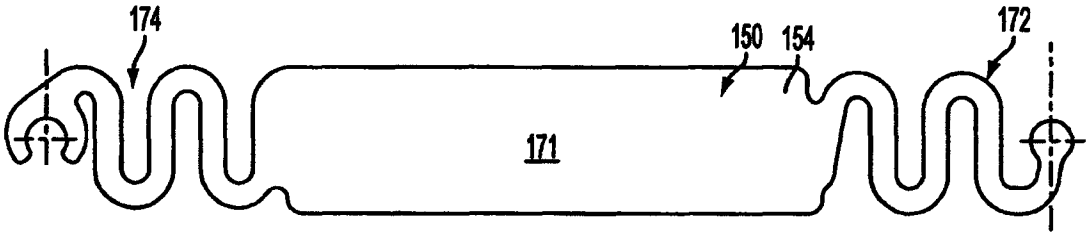
FIG. 5 is a top plan view of an alternative embodiment of a band.
Figure 5A:
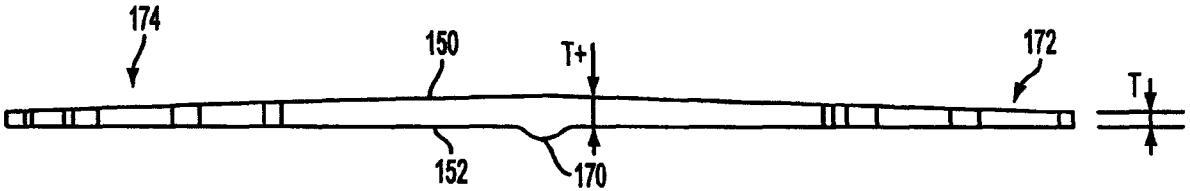
FIG. 5A is a side elevational view of the embodiment of the band of FIG. 5.

FIGS. 5 and 5A illustrate an alternative form of band that has a non-uniform thickness. In the embodiment of these figures, a central or intermediate portion of the band is thicker than the thickness of the end portions of the band (compare the thickness T+ with the thickness T). By adjusting the thickness of the band to vary over its length, additional control of the lift of the valve can be achieved.

Figure 6:
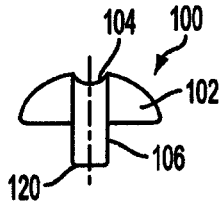
FIG. 6 is a side elevational view of one embodiment of a cam adjustment portion that can be used in the cam assembly of FIG. 2 or 3.
Figure 6A:
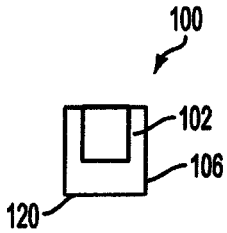
FIG. 6A is an end view of the cam adjustment portion of FIG. 6.
Figure 6B:
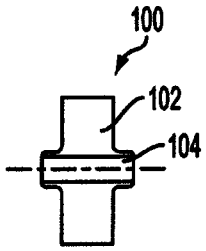
FIG. 6B is a top view of the cam adjustment portion of FIG. 6.

FIGS. 6, 6A and 6B show respective front elevation, side elevation, and top views of an exemplary cam adjustment portion that can be usable in the embodiments of FIGS. 2, 2A, 2B and 3. In FIG. 6B, one can see an exemplary groove 104 extending transversely across the cam adjustment portion from a front side thereof to a back side thereof.

Figure 7:
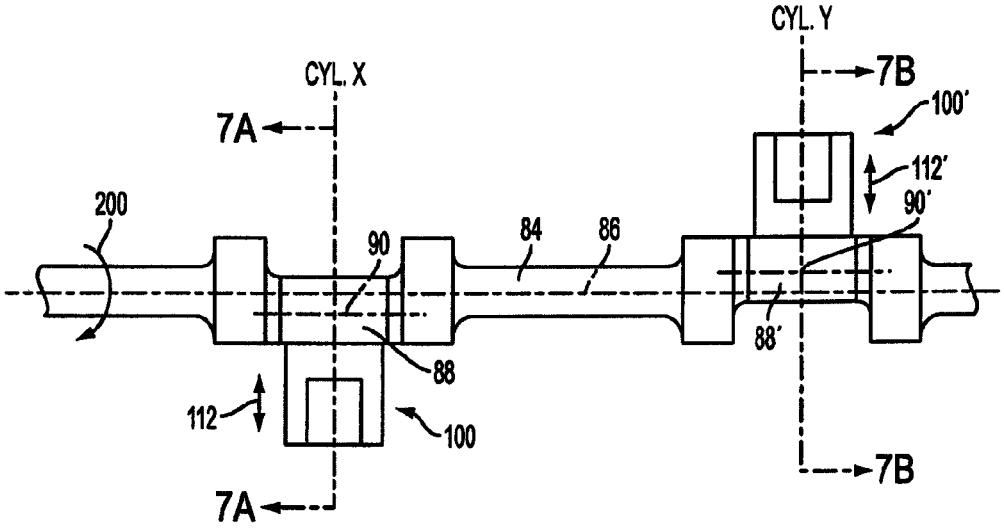
FIG. 7 is a schematic illustration of a portion of an embodiment of a valve actuating shaft with plural cam adjustment portions shown in full lift positions of the cam adjustment portions on eccentric portions of the shaft and with the cam body portions eliminated for convenience.
Figure 7A:
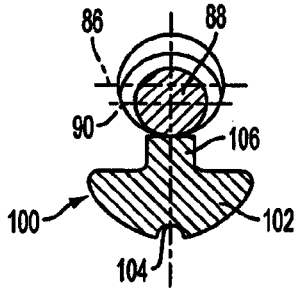
FIG. 7A is a sectional view through one of the cam adjustment portions shown in FIG. 7, taken along line 7A-7A of FIG. 7, with this cam adjustment portion being associated with one or more valves of a first engine cylinder X.
Figure 7B:
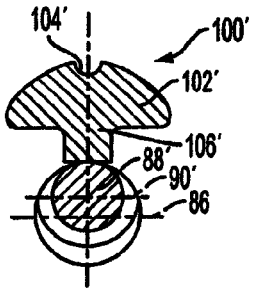
FIG. 7B is a sectional view through another cam adjustment portion shown in FIG. 7, taken along line 7B-7B of FIG. 7, with the cam adjustment portion being associated with one or more valves of another cylinder Y of an internal combustion engine.
Figure 7C:
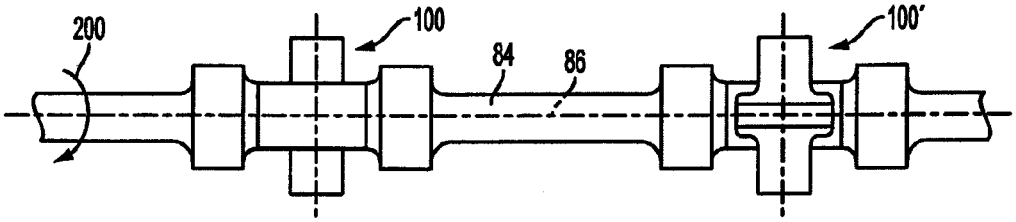
FIG. 7C is a view of the valve actuating shaft portion of FIG. 7 with the valve actuating shaft having been rotated 90 degrees from the position shown in FIG. 7.

FIG. 7 illustrates a portion of a valve actuating shaft 84 having first and second eccentric portions 90, 90' coupled to respective cam adjustment portions 100, 100'. In this figure, the cam body portions have been eliminated for purposes of clarity. Rotation of the shaft 84 in the direction of arrow 200 about the shaft axis 86 and relative to the cam body portions and cam adjustment portions moves the respective eccentrics 88, 88' relative to the cam body portions to shift the cam adjustment portions 100, 100' together outwardly or inwardly relative to the cam body portions. Arrows 112, 112' indicate the respective directions of movement. In the FIG. 7 embodiment, the cam adjustment portion 100 is associated with one or more valves of a cylinder X of an internal combustion engine. In addition, the cam adjustment portion 100' is associated with one or more valves of a cylinder Y of the internal combustion engine. By associated, it is meant that the cam adjustment portion causes (e.g., via a cam follower) the opening and closing of the valves of the associated cylinder as the engine is operated. FIG. 7A illustrates a sectional view along line A-A of FIG. 7, taken through the cam adjustment portion 100 and eccentric portion 88. FIG. 7B is a vertical sectional view taken along line B-B of FIG. 7 showing the cam adjustment portion 100' and eccentric portion 88'. FIG. 7C illustrates a cam section 84 of FIG. 7 rotated in the direction of arrow 200 through an angle of 90 degrees from the position shown in FIG. 7. It should be understood that the shaft 84 can support one, two or more cam assemblies.

Figure 8:
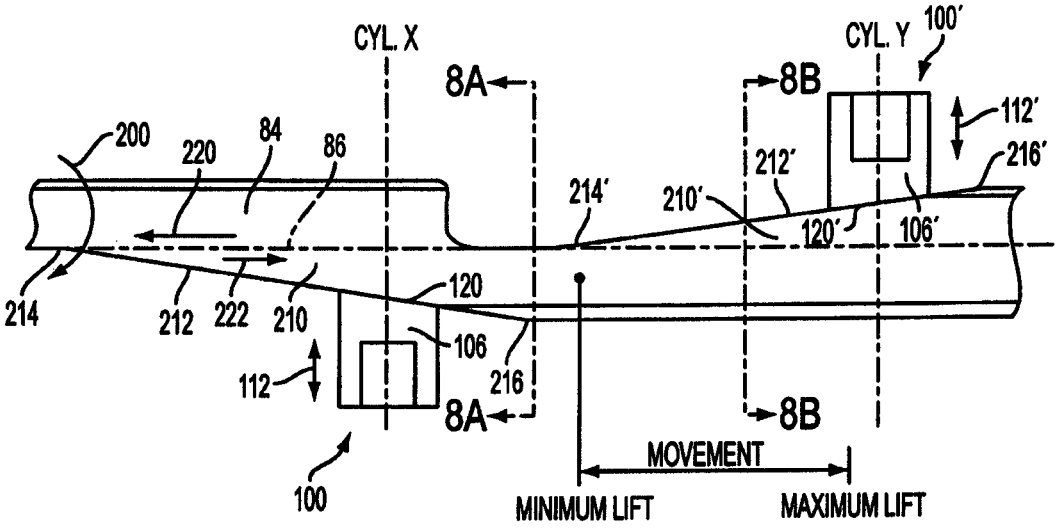
FIG. 8 is a view of a form of valve actuating shaft with camming wedge portions each being coupled to an associated respective one of the cam adjustment portions, with two such cam adjustment portions being shown in FIG. 8 and with the cam body portions being eliminated from FIG. 8 for convenience.

FIGS. 8, 8A, 8B and 8C illustrate an alternative form of valve actuator for shifting the positions of the cam adjustment portions of the cam assemblies. In the embodiment of FIG. 8, the shaft 84 is provided with a respective wedge for each of the cam assemblies. Thus, with reference to FIG. 8 which depicts the cam adjustment portions 100, 100' of two such cam assemblies, a first wedge 210 is provided for adjusting the position of the cam adjustment portion 100 and a second such wedge 210' is provided for adjusting the position of the cam adjustment portion 100'. In the embodiment of FIG. 8, wedge 210 comprises a wedging surface 212 that is inclined from a position 214, that can be generally in a plane corresponding to a plane containing the shaft axis 86, to a location 216. In addition, the wedge 210' comprises an inclined wedge surface 212' with the incline commencing at a location 214', that can be generally in a plane containing the shaft axis 86, and terminating at a location 216'. The cam adjustment portions 100, 100' in FIG. 8 are disposed on opposite sides of the shaft from one another and thus the wedges 210, 210' are also on opposite sides of the shaft. In addition, the base 120 of the projection 106 of the illustrated form of cam adjustment portion 100 is inclined to match the incline of wedge surface 212. In the same manner, the base 120' of the projecting portion 106' of the illustrated form of cam adjustment portion 100' is inclined to match the incline of the wedge surface 212'. To shift the cam adjustment portions 100, 100' outwardly, the shaft 84 is moved axially to the left in FIG. 8 in a direction parallel to the axis 86 as indicated by arrow 220. To allow the cam adjustment portions 100, 100' to shift inwardly, the shaft 84 is moved axially to the right in FIG. 8, as indicated by the directional arrow 222. A motor or other axial shaft shifting mechanism (such as a rack and pinion mechanism) can be used to shift the shaft 84 axially as desired to adjust the position of the cam adjustment portions and thereby the actuation (opening and closing) of the associated valves between full load and zero load operating conditions.

Figure 8A:
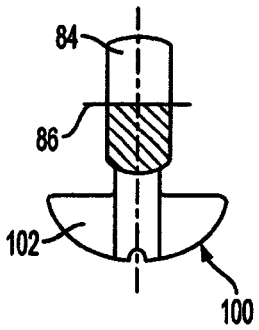
FIG. 8A is a sectional view through one of the cam adjustment portions shown in FIG. 8, taken along line 8A-8A of FIG. 8, with the cam adjustment portion positioned on a first camming wedge and associated with one or more valves of a cylinder X of an internal combustion engine.
Figure 8B:
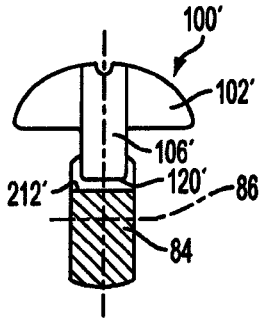
FIG. 8B is a sectional view through another cam adjustment portion shown in FIG. 8, taken along line 8B-8B of FIG. 8, with this cam adjustment portion positioned on a second camming wedge and associated with one or more valves of another cylinder Y of the internal combustion engine.
Figure 8C:
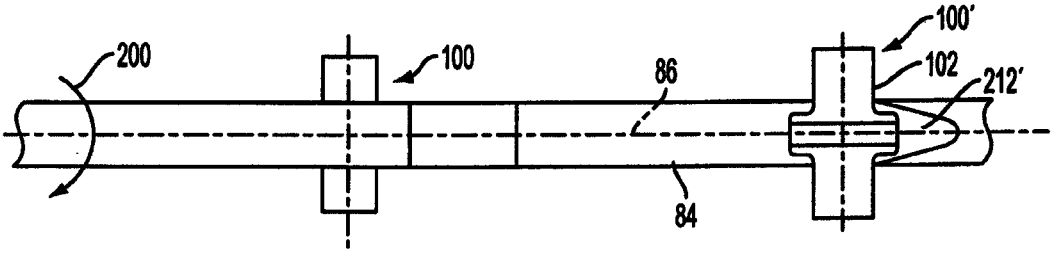
FIG. 8C is a top view of the valve actuating shaft of FIG. 8 with the shaft rotated 90 degrees from the position shown in FIG. 8.

FIG. 8A is a sectional view through a portion of the shaft 84 taken along line A-A of FIG. 8. FIG. 8B is a sectional view through a portion of the shaft 84 taken along line B-B in FIG. 8. FIG. 8C illustrates a portion of the shaft shown in FIG. 8 at a position rotated 90 degrees in the direction of arrow 200 from the position shown in FIG. 8.

In addition to varying the lift of the valve as explained above, in accordance with alternative embodiments, the timing of the valve operation can also be changed by adjusting the peripheral shape of the cam. More specifically, the cam shape can be changed to cause the valve to open earlier and close later under first engine speed or load conditions corresponding to relatively higher engine operating speeds or loads and open later and close earlier at second engine speeds or loads corresponding to relatively lower engine speeds or loads. Desirably the timing can be continuously varied with changes in engine speed or load and can also be varied with changes in the valve lift.

Figure 9:
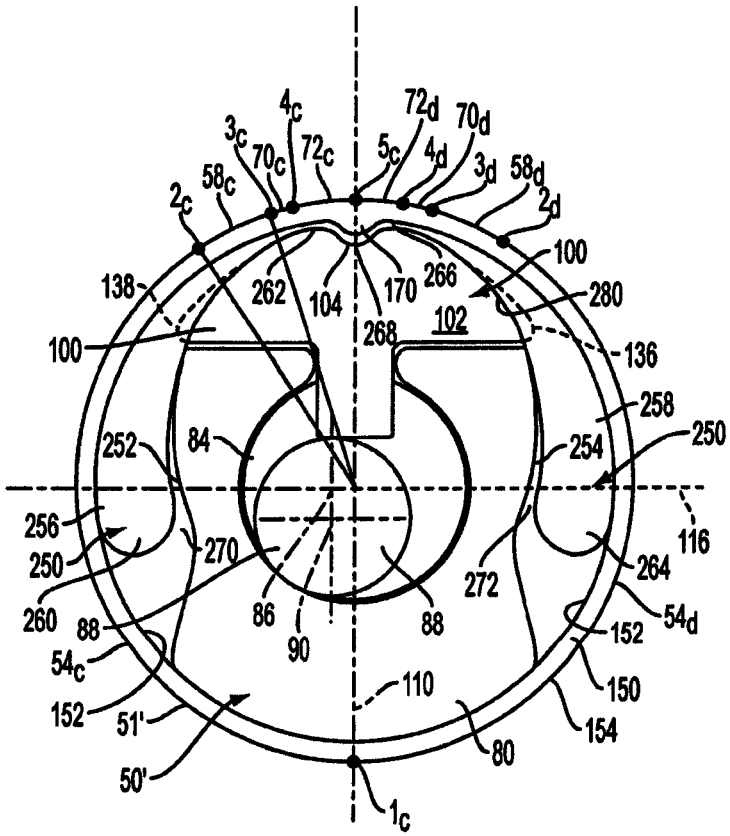
FIG. 9 is an illustration of an embodiment of a cam assembly with one form of a valve timing adjustment mechanism with the cam assembly in FIG. 9 having a periphery of a first shape or configuration.

FIG. 9 illustrates an embodiment wherein the valve timing is variable. In addition, in the embodiment of FIG. 9, the valve timing is variable with the variation in valve lift. In the exemplary embodiment of FIG. 9, the cam adjustment portion 100 is shown shifted to a low lift or engine idle position. In addition, the cam body portion as indicated at 50' with the cam periphery being indicated at 51'. The illustrated cam assembly has a first base circuit portion 54*c* from point 1*c* to point 2*c*, a ramp portion 58*c* from point 2*c* to point 3*c*, a flank portion 70*c* from point 3*c* to point 4*c* and a cam portion 72*c* from point 4*c* to point 5*c*. In addition, the cam periphery has a second top portion 72*d* from point 5*d* to point 4*d*, a second flank portion 70*d* from point 4*d* to point 3*d*, a second ramp portion 58*d* from point 3*d* to point 2*d* and a second base circuit portion 54*d* from location or point 2*d* to location or point 1*c*. Under the engine idle condition of FIG. 9, as the valve assembly is rotated, lifting of the valve is delayed until the ramp begins at location 2*c* with full closing of the valve being completed at location 2*d*. Thus, the timing of the valve is such that it opens later at a low idle speed and closes earlier at the low idle speed than at higher speeds. That is, with reference to FIG. 9A, in this figure the cam top portion 102 has been shifted to a full lift position. Under this condition, as explained more fully below, the ramp 58*c* and the commencement of valve opening begins at location 2*c* with valve closing being completed at the end of ramp 58*d* at the location 2*d*. As one can see from comparing FIGS. 9 and 9A, location 2*c* is much earlier in FIG. 9A than in FIG. 9 and location 2*d* is much later in FIG. 9A than in FIG. 9. Thus, the valve is open longer under the conditions of FIG. 9A than the conditions of FIG. 9 to provide more power if the engine is operated at higher speeds or loads when the valve cam has the configuration shown in FIG. 9A than if the engine is operated at lower speeds or loads with the valve cam having the configuration shown in FIG. 9.

Figure 9A:
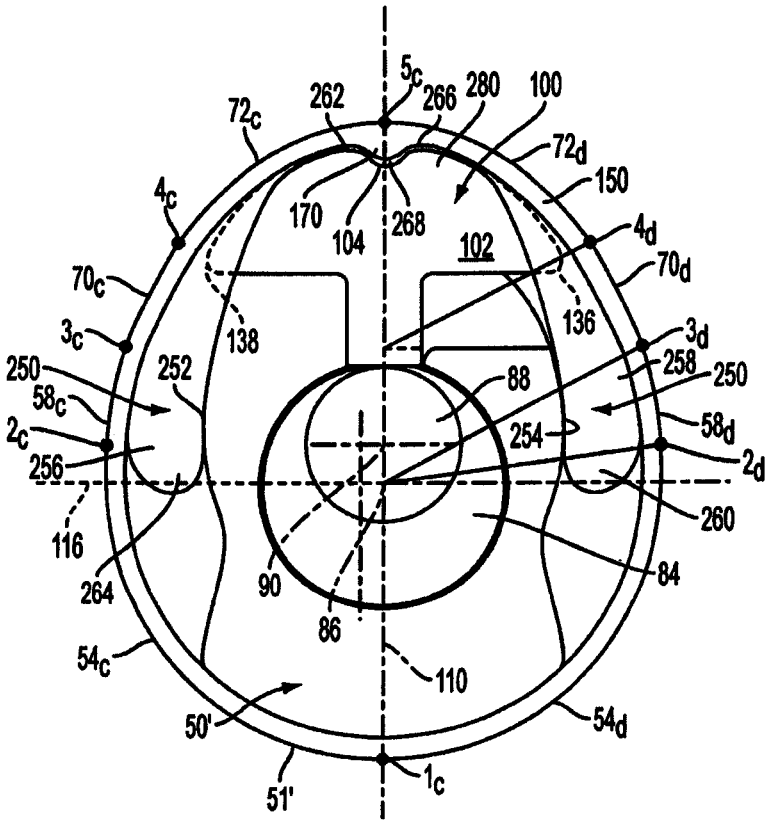
FIG. 9A illustrates the cam assembly of FIG. 9 in a different configuration that corresponds to a different lift and different timing of actuation of the associated valve than achieved with the cam assembly configuration of FIG. 9.

In the embodiment of FIGS. 9 and 9A, a wedging mechanism, such as comprising wedge structures such as indicated generally by the numbers 250, can be used to push out the sides of the periphery of the cam assembly to adjust the timing as the cam adjustment portion 100 is lifted. The illustrated wedge structures 250 comprise respective wedging surfaces 252, 254 that can be formed in the cam body portion 80. The illustrated wedging surfaces 252, 254 can be of a convex configuration and desirably follow the contour of a spiral as explained below. In addition, the illustrated wedging structures comprise respective first and second wedges 256, 258. The wedge 256 is shown positioned at least partially between the interior surface 152 of the surround 150 and the wedging surface 252. In addition, the wedge 258 is shown positioned at least in part between the interior surface 152 of the surround 150 and the wedging surface 254. The wedge 256 comprises a base portion 260 and a tip portion 262. The wedge 258 comprises a base portion 264 and a tip portion 266. The two tip portions 262, 266 can be joined together by a bridge or wedge connecting portion 268 positioned in this case adjacent to the maximum lift location 5*c*. The bridge 268 can be formed with a downward bending portion or bridge projection positioned within a recess 104 at the top of the cam top portion 102. In addition, the upper portion of the bridge portion 268 can define a recess for receiving a projection 170 of a surround such as band 150. This construction illustrates one exemplary approach for retaining the band and wedges from shifting rotationally relative to the cam top portion 102. Although other wedge shapes can be used, the illustrated wedges 256, 258 can generally be described as tear drop or tear shaped. In addition, the base portions 260, 264 are rounded and the tip portions 262, 266 are acute. When in the idle position shown in FIG. 9, a gap 270 is provided between wedge surface 252 and the base of the wedge 256 and a gap 272 is provided between the base of the wedge 258 and the wedging surface 254. As a result, when the cam assembly is in the position shown in FIG. 9, the illustrated wedges 256, 258 are not applying pressure to the interior of the surround 150 from point 1*c* to 2*c* and from point 2*d* to lc so that the wedges do not adjust the shape of the surround. From point 2*c* to 3*d* and 3*d* to 2*d* the wedges 256, 258 are applying pressure to the interior surface of the surround 150 so that the wedges do adjust the shape of the surround at these locations. The shape of the wedging surfaces 252, 254 and the configuration of the wedges 256, 258 can be changed from the shapes shown in FIG. 9 to alter the wedging action if desired.

In comparison, upon lifting the cam adjustment portion 100 as shown in FIG. 9A, the wedges 256, 258 are also lifted or shifted upwardly such that the interior surface of wedge 256 engages the wedging surface 252 and the interior surface of the wedge 258 engages the wedge 254 with the exterior surfaces of the wedges each engaging an interior surface of the surround 150 to a greater extent (e.g., including from the point 2*c* to 3*c* and 3*d* to 2*d*). Lifting of the wedges results in urging the surround outwardly and adjusts the location where valve opening commences at point 2*c* and valve closing ends at point 2*d*. As can be seen in FIG. 9A, under the conditions of this figure, the gaps 270, 272 have been eliminated. In the construction shown in FIGS. 9 and 9A, as the cam adjustment portion 100 is lifted, the wedges are moved to engage the respective wedging surfaces with greater wedging action being achieved as lifting continues.

Figure 9B:
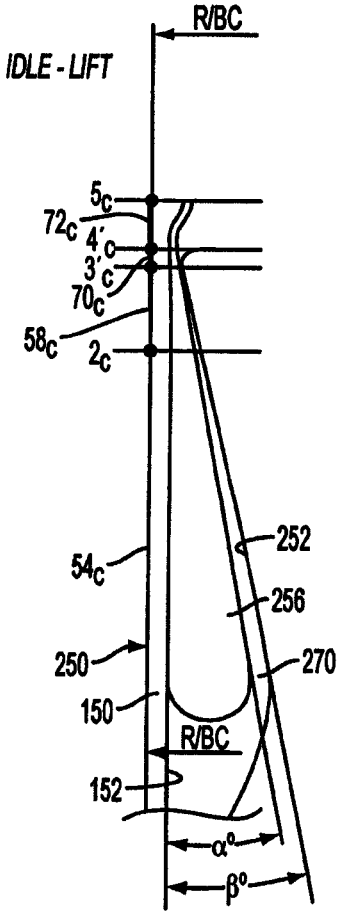
FIG. 9B is a schematic illustration of a plane projection of one form of timing adjustment mechanism in a first valve timing position, such as an idle lift position.
Figure 9C:
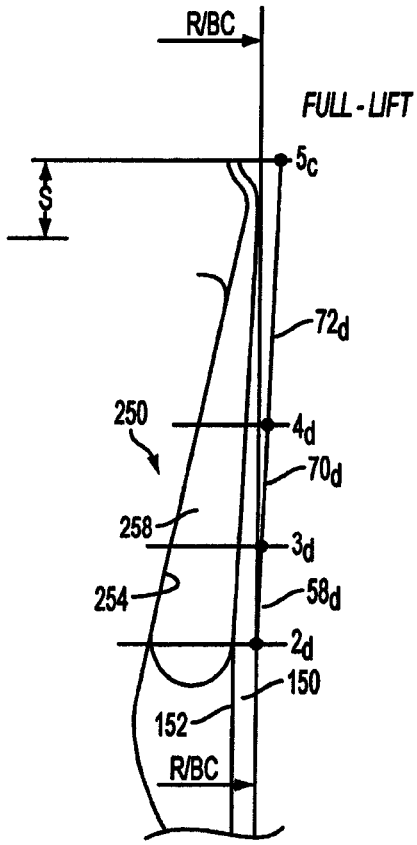
FIG. 9C is a schematic illustration of a plane projection of the form of timing adjustment mechanism of FIG. 9A in another valve timing position, such as a full lift position.

FIGS. 9B and 9C illustrate plane projections of the wedges and wedging surfaces of FIG. 9 and FIG. 9A shown in respective idle and full lift positions. As can be seen in the plane projection of FIG. 9B, the angle alpha ($\alpha$) between the exterior surface of the wedge and the interior surface 152 of the band 150 is less than the angle beta ($\beta$) between the surface 152 and the wedging surface 252 such that the gap 270 is provided between the wedge and wedging surface when the cam adjustment portion 100 is in an idle position. In contrast, when shifted to the full lift position shown in FIG. 9C, the gap between wedging surface 254 and wedge 258 has been eliminated such that wedging is accomplished and the locations 2*d*, 3*d*, 4*d* and 5*c* have shifted (as have the locations 2*c*, 3*c* and 4*c*) to cause the valve to open for a longer period of time.

Figure 11A:
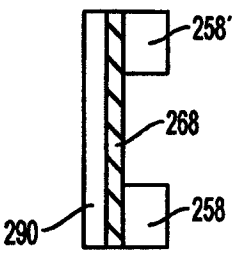
FIG. 11A is a sectional view through a portion of the wedge mechanism of FIG. 11, taken along 11A-11A of FIG. 11.
Figure 11:
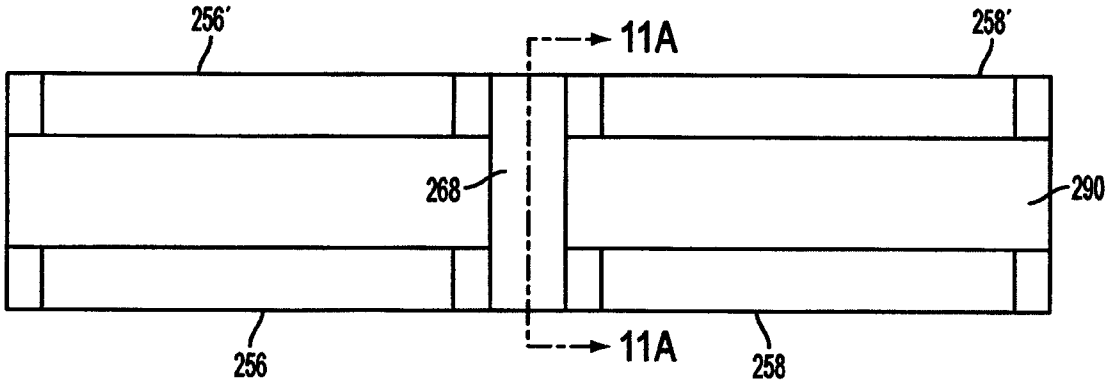
FIG. 11 is a top view of one form of a wedge mechanism, shown in a flattened (unassembled) configuration, for use in adjusting the timing of valve actuation by adjusting the shape of the periphery of the cam.
Figure 11B:
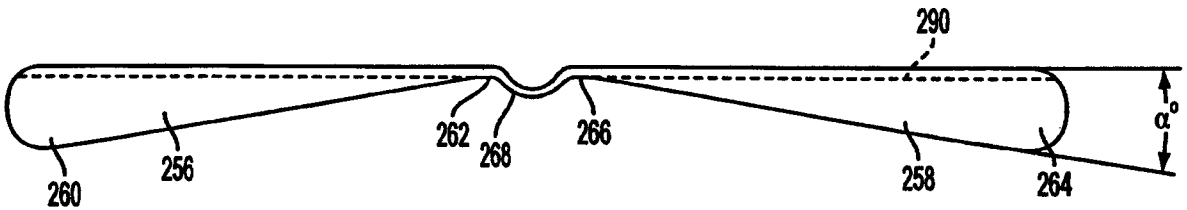
FIG. 11B is a side elevational view of the wedge mechanism of FIG. 11.

Referring again to FIG. 9, the wedges 256, 258 thus comprise one set of wedges with the wedge 256 leading in the direction of rotation of the cam assembly and the wedge 258 lagging in the direction of rotation of the cam assembly. In addition, the wedges 256, 258 are positioned adjacent to a front surface 280 of the cam adjustment portion 100. As explained below, a second set of first and second wedges, like wedges 256, 258, can be positioned at the opposite or rear side of the cam adjustment portion 100. The bridge 268 can join the two sets of wedges together. In addition, the two sets of wedges can also be joined together by a base such as a strap or band with the wedges 256, 258 of the first set being positioned along one side edge of the base portion and the wedges of the second set being positioned along the opposite side edge of the base. This construction of an exemplary wedging mechanism comprising dual sets of wedges is shown in FIGS. 11, 11A and 11B. With reference to FIG. 11, a second set of wedges comprising wedges 256' and 258' is shown spaced from the wedges 256, 258 with the bridge portion 268 extending therebetween. A base 290 can also extend between the respective wedges of the set. With this construction, the cam top portion 102 (FIGS. 6A and 9A) can be positioned between the respective sets of wedges with the bridge 268 being received within a recess 104 (FIGS. 6C and 9A) provided at the top of the cam top portion.

It should be noted that although FIGS. 9 and 9A illustrate the cam adjustment portion being shifted by an eccentric, an alternative mechanism for moving the cam adjustment portion outwardly and inwardly can be used, such as the wedge mechanism of FIGS. 8, 8A, 8B and 8C.

Figure 10A:
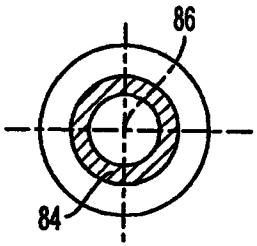
FIG. 10A is a sectional view through the shaft of FIG. 10, taken along line 10A-10A of FIG. 10.
Figure 10D:
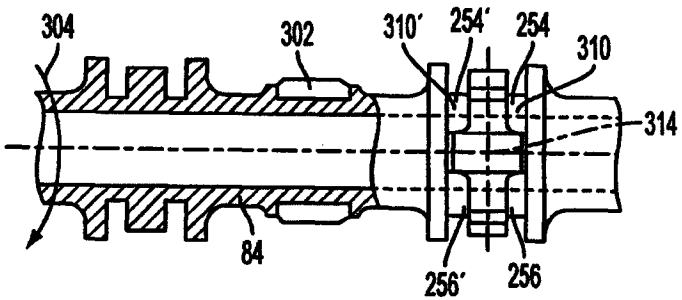
FIG. 10D is a view of the shaft of FIG. 10, partially in section, and shown rotated 90 degrees from the position shown in FIG. 10.
Figure 10:
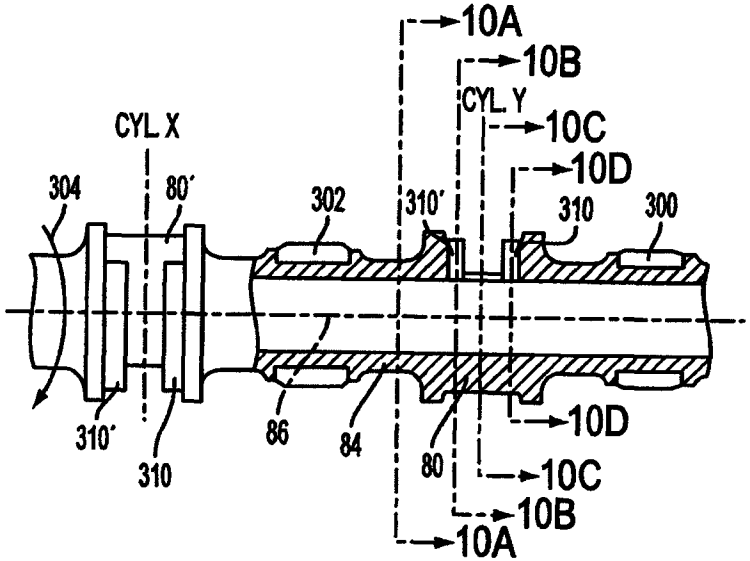
FIG. 10 is a view of a portion of a valve actuating shaft, partially in section, that can be used with cam assemblies having the variable timing mechanism shown in FIG. 9.
Figure 10C:
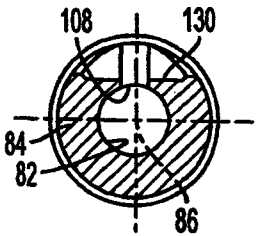
FIG. 10C is a sectional view through a portion of the shaft of FIG. 10, taken along line 10C-10C of FIG. 10.
Figure 10B:
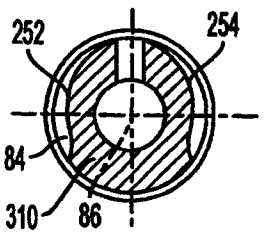
FIG. 10B is a sectional view through a portion of the shaft of FIG. 10, taken along line 10B-10B of FIG. 10 (and also taken along line 10D-10D of FIG. 10).

FIG. 10 illustrates a portion of a valve actuating shaft with wedging surfaces such as described above in connection with FIG. 9, and cam body portions such as described above in connection with FIG. 2, included therein. The illustrated shaft 84 is supported by a portion of the vehicle, such as by the cylinder head of the engine, for rotation with bearings 300, 302 being provided for this purpose. A cam body 80' is shown associated with the valves of a first cylinder X and a cam body 80 is shown in association with the valves of a second cylinder Y (although the valves are not shown in this figure). One or more cam bodies can be included along the valve actuating shaft. The cam bodies can be formed integral with the shaft. The valve actuator, such as an eccentric or wedge supporting shaft, can extend into the hollow interior of shaft 84 and be moved relative to the shaft 84 (e.g. pivoted in the case of an eccentric containing actuator or slid axially in the case of a wedge actuator) to control the positions of the cam top portions. In addition, the wedging surfaces can also be formed integral with the valve actuator shaft. FIG. 10D illustrates the shaft 84 rotated 90 degrees from the position shown in FIG. 10. The section taken along line C-C in FIG. 10, as shown in FIG. 10C, passes through the center of the cam body 80. A comparison of FIG. 10C with FIG. 2 and FIG. 2A and the previous description will make this portion of the shaft clear without the need for further description as these components have been described in detail above. The sections along lines B-B and D-D, shown in FIG. 10B, illustrates one form of a wedging surface defining or supporting shaft portion 310 on which the wedging surfaces 252, 254 can be formed or positioned. As can be seen in FIG. 10, a first wedge supporting portion 310 is positioned axially along the shaft adjacent at one side of the cam top receiving portion of the cam body portion 80 and the wedging surface supporting portion 310' that defines or supports wedging surfaces for a second set of wedges is positioned axially at the opposite side of the cam top receiving portion of the cam body portion. FIG. 10D illustrates a top view of the cam top receiving opening 314 and also best shows an embodiment of the two wedge surface supporting portions 310, 310' with a first set of wedges 254, 256 formed on wedge support surface support 310 and a second set of wedges 254', 256' formed in the wedge surface support 310'. Also, FIG. 10A shows a section taken along line A-A of FIG. 10 spaced from the bearings 302, 300 and from the cam body portions 80, 80'.

Figure 12:
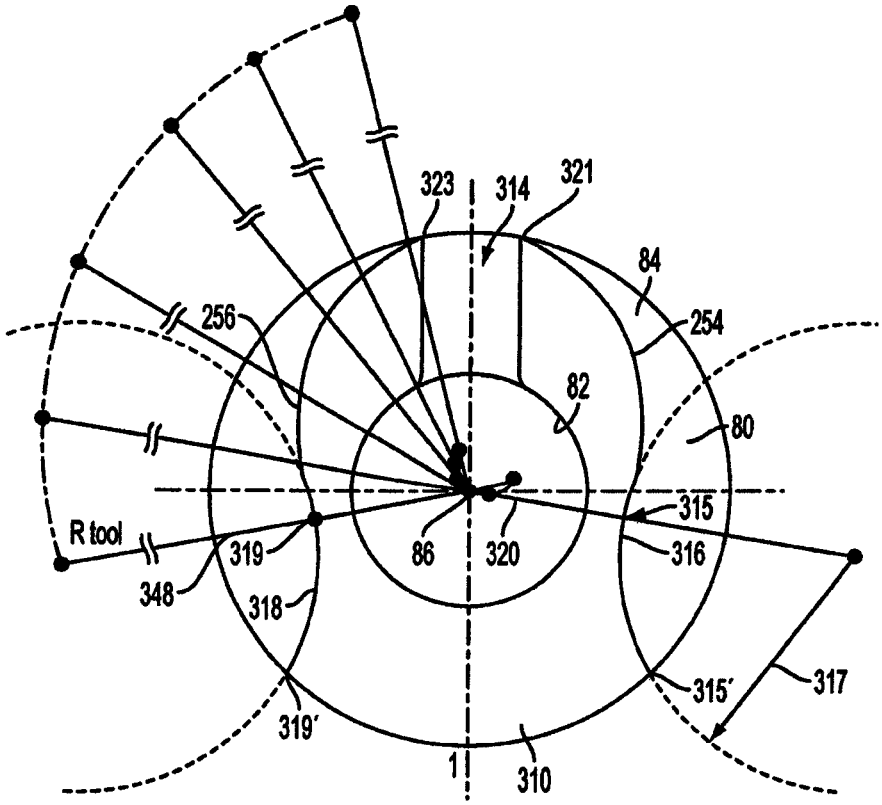
FIG. 12 is an end view of a wedging portion of the valve actuating shaft of FIG. 10 having exemplary wedging surfaces for engaging in pushing wedges of the wedge assembly outwardly to adjust the peripheral shape of the cam and the timing of valve actuation as the cam adjustment portion is lifted.

With reference to FIG. 12, the wedging surfaces can be formed on the shaft 84 in any suitable manner. For example, these surfaces can be machined or the shaft can be cast, forged, or otherwise manufactured to provide these surfaces. For example, at the lower portion of the shaft 310, the surfaces 316, 318 can be machined using a circular machining tool having a radius 317 from locations 315' to 315 for surface 316 and from location 319' to 319 for surface 318. The shape of surfaces 316, 318 can be varied. From location 315 to location 321 and from location 319 to location 323, this tool desirably machines, in a spiral swing, the wedging surfaces 254, 256 in a spiral form. Spiral means all the radii pass through the center point 86. The voids formed by this machining step can accommodate wedges when the cam assembly is assembled. Desirably the surfaces 254, 256 are concave and more desirably the surfaces 254, 256 each follow a spiral. The machining can be accomplished by a machining tool having a radius Rtool with the center of the tool following a spiral indicated by the number 320 as the surface 256 is formed. The same tool can be used to form the surface 254. It should be noted that the surfaces 254 and 256 do not have to be identical. By having surfaces 254, 256 follow a spiral, as the wedges push the periphery of the cam assembly outwardly, discontinuities in valve acceleration are minimized as the motion of the wedges and the outward pressure from the wedges is guided by the spirally shaped wedging surfaces 254, 256.

Figure 13:
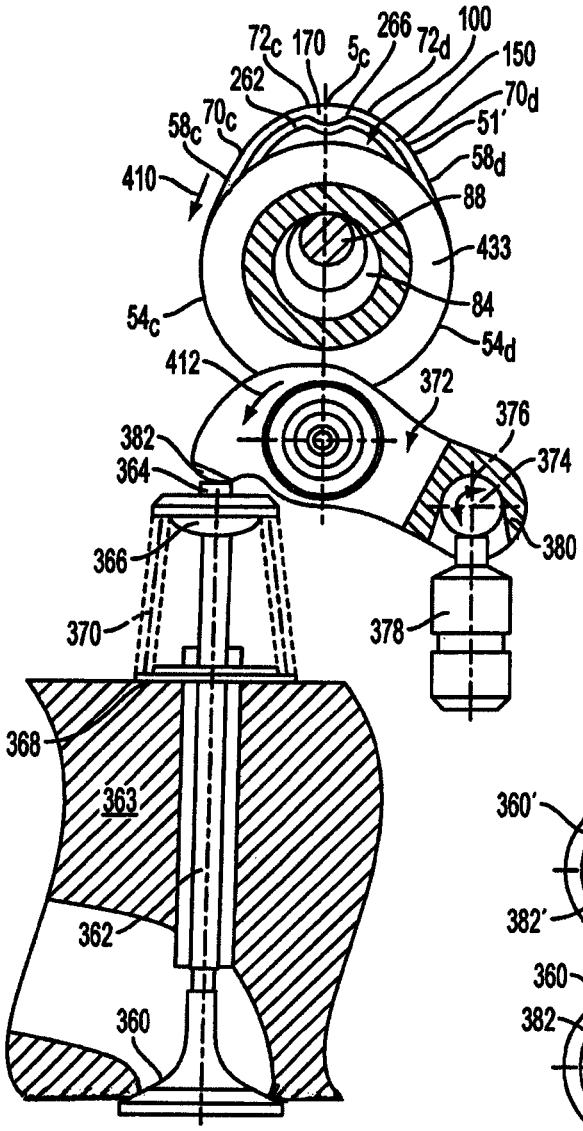
FIG. 13 illustrates one embodiment of a cam assembly with variable valve lift and valve timing shown in combination with a rocker arm and first and second valves, although only one such valve is visible in FIG. 13.
Figure 13B:
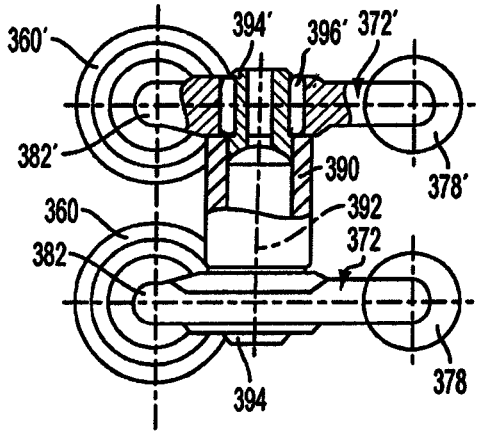
FIG. 13B is a top view of the valve assembly of FIG. 13.
Figure 13A:
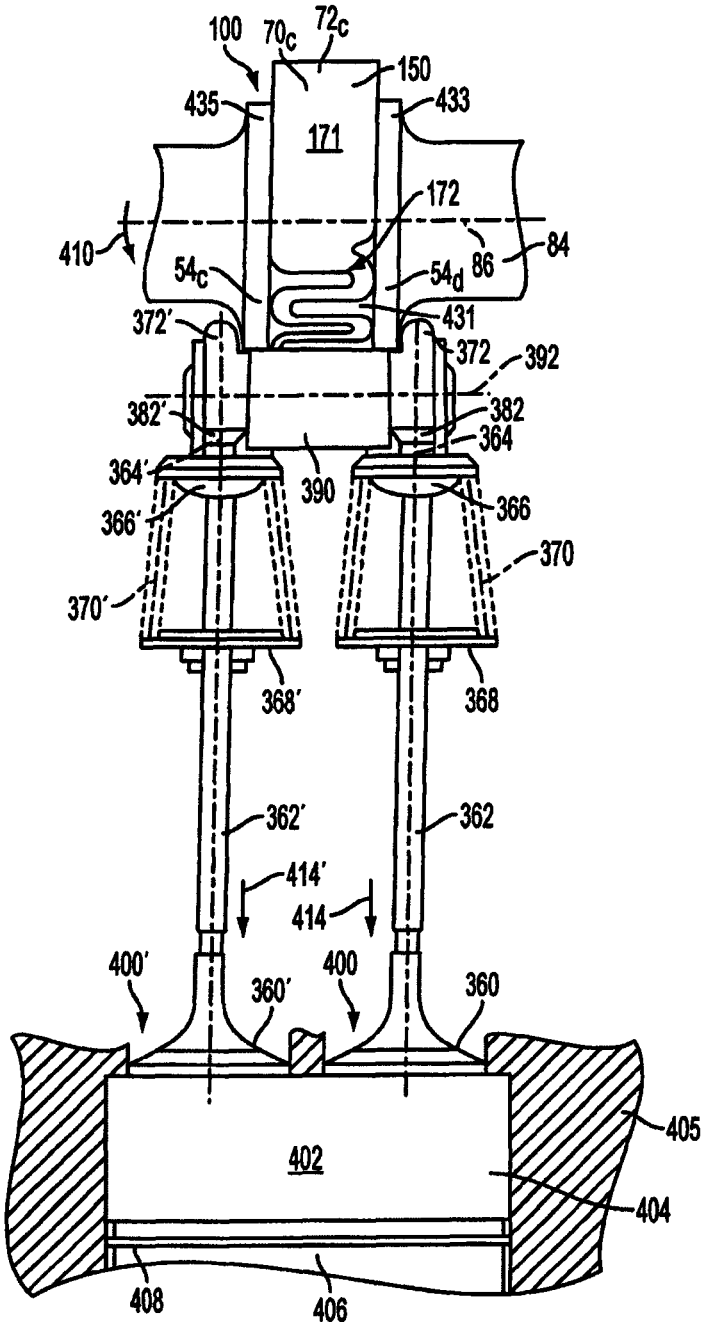
FIG. 13A is a front view of the assembly of FIG. 13 with a portion of an associated cylinder and piston of an engine shown in this Figure.

FIGS. 13, 13A and 13B illustrate the cam assembly of FIGS. 9 and 9A in operation to control one or more valves of a cylinder of an internal combustion engine. The operation of the embodiment of FIG. 3 would be similar except that the timing would not be adjusted using the embodiment of FIG. 3. With reference to FIG. 13, the cam assembly is shown in this figure in a maximum lift position with the eccentric portion 88 pushing the cam adjustment portion 100 outwardly (upwardly in this figure) to its maximum extent. In the embodiment of FIG. 13, a first intake valve 360 is supported by the distal end of a valve stem 362. The valve stem 362 is supported in the cylinder head 363 (shown in FIG. 13). An end portion 364 of the valve stem engages a rocker arm 372. A spring support 366 is mounted to the valve stem 362 and one or more valve closing springs 370 are coupled between member 366 and a member 368 which rests, in this example, on the cylinder head. A swing lever or rocker arm 372 is shown pivotally supported for pivoting about an axis 374 in directions indicated by arrow 376. A conventional slack adjustment mechanism 378 is also coupled to the pivot support at the end 380 of the rocker arm 372. The rocker arm 372 has an end portion 382, spaced from pivot 374, that is positioned to engage the upper end 364 of the stem 362. Although only a single rocker arm and valve can be associated with a respective cam assembly, in the embodiment shown in FIGS. 13, 13A and 13B, two such valves are coupled to one cam assembly with each valve being operated by a respective rocker arm. In these figures, the second valve and second rocker arm have elements labeled with the same numbers used for the first valve and first rocker arm except a' (prime) designation has been used with the numbers of the components of the second rocker arm and second valve.

Following assembly of the variable cams with the surrounds (e.g. with bands 150) on the shaft 84, the cam surrounds can be finished, such as by grinding, to eliminate any uneven tolerances between the different cams and to adjust the small idle lift and full lift positions of the cams for smooth engine operation.

In the embodiment of FIGS. 13, 13A and 13B, a common roller 390 is rotatably coupled to each of the rocker arms for rotation about an axis 392 that is parallel to the axis 86 of the valve actuating shaft 84. In the embodiment as shown in FIG. 13B, the roller 390 is hollow with respective bearing seat containing members 394, 394' inserted into and mounted to the respective ends of the roller 390. Bearing seat member 394' is best seen in FIG. 13B. Bearings, such as needle bearings 396', rotatably couple seat member 394' to the rocker arm 372'. Similar bearings (not shown in FIG. 13B) rotatably couple the seat member 394 to the rocker arm 372. As a result, the roller 390 is free to rotate relative to the rocker arms.

With reference to FIGS. 13 and 13A, the shaft 84 is provided with spaced apart flanges 433, 435 that desirably can have a right cylindrical peripheral surface. A respective set of such flanges is desirably associated with each cylinder. A recess 431 is provided between the flanges 433, 435. The surround 150 can be positioned so as to lie partially within the recess. More specifically, the spring portion 172 can be positioned within the recess. The top portion of the cam assembly projects outwardly from the recess upon extension of the adjustable portion of the cam assembly. As thus seen in FIGS. 13 and 13A, a portion of cam 58*c*, 58*d* and top circuit portions 72*c* and 72*d* extend outwardly from the cam body 433 and, in FIG. 13A, the projection of circuit portions 70*c*, 72*c* from recess 431 is apparent. As the cam assembly is rotated, the base portions 54*c* and 54*d* of the cam assemblies, which comprise a portion of the periphery of the flanges 433, 435 in this example, engage the cam roller 390. The spring portion 172 within recess 431 is desirably positioned below the peripheral surfaces of the cam body flanges 433, 435 so that the spring portion does not roll in contact with the roller 390. As the shaft 84 rotates, the body portion 171 of the surround 150 is the portion of the surround that engages the roller 390 in this example. The flanges 433, 435 also guide the movement of the adjustable portion of the cam radially outwardly and inwardly and restrict the motion of the cam in either direction along the longitudinal axis 86 of the shaft 84. Less desirably, the cam assembly can be constructed such that the spring portion of the band also rolls in contact with the roller. With further reference to FIG. 13, the flanges 433, 435 can be of a height such that, when the adjustable portion of the cam is fully retracted (moved to its radially inwardly most portion), the cam top portions 72*c*, 72*d* are positioned at or below the periphery of the flanges 433, 435. In this case, corresponding to zero valve lift, the roller 390 runs entirely on the base circuit (R/BC), that is on the peripheral surfaces of the flanges 433, 435. When the valve adjustment portion of the cam is lifted, see FIGS. 9A and 13, the illustrated roller runs from point 1*c* to point 2*c* and from point 2*d* to point 1*c* on the base circuit (on the surfaces of the respective flanges 435, 433. In this example, from location 2*c*, where the roller engages the surround to location 5*c*, and from location 5*c* to location 2*d*, where the roller disengages the surround, the roller contacts the surround adjustment portion of the cam. Thus, desirably, over at least a portion of the ramps 58*c*, 58*d*, flanks 70*c*, 70*d* and top portions 72*c*, 72*d* of the cam assembly, the roller engages the body 171 of the band. In contrast, the roller in this example does not engage the spring portions of the surround while the base circuit portions of the rotating cam assembly pass the roller.

With reference to FIG. 13A, the valve 360 is shown blocking an air intake opening 400 leading to the combustion chamber 402 of a cylinder 404 of internal combustion engine 405. A reciprocating piston 406 is shown positioned in the cylinder for sliding upwardly and downwardly within the illustrated cylinder 404 with a piston ring 408 shown engaging the interior wall of the cylinder.

In operation, as the shaft 84 is rotated in the direction of arrow 410, the ramp portion 2*c* of the periphery of the cam assembly (see FIG. 9A) will roll against the roller 390 causing the rocker arms 372, 372' to pivot downwardly in the direction of arrow 412 (FIG. 13). This will cause the valve stems 362, 362' and associated valves 360, 360' to move downwardly in the embodiment of FIG. 13A in the direction of arrows 414, 414'. As a result, the respective passages 400, 400' start to open to allow combustion air to flow into the combustion chamber 402 of the cylinder 404. Continued rotation of the cam assembly in the direction of arrow 410 continues the movement of the valves 360, 360' in the direction of arrows 414, 414' until the top position 5*c* is reached, at which point the openings 400, 400' are open to their maximum extent. Continued rotation of the cam assembly allows the pivoting of the lever arms 372, 372' in a direction opposite to the direction 412 with springs 370, 370' moving the valves 360, 360' in a direction opposite to the directions 414, 414' to start to close the valve openings 400, 400'. This closing process continues until location 2*d* (FIG. 9A) is reached, at which point the valves are in their closed position. The valves remain closed until the shaft 84 and cam assembly has been rotated sufficiently such that location 2*c* on the cam assembly (FIG. 9A) again engages the roller 390 and opening of the valves 360, 360' recommences as previously explained.

Reducing the lift, by adjusting the position of the cam adjustment portion 100 inwardly relative to the cam body, reduces the maximum extent to which the valve openings 400, 400' are opened. In addition, for cam assemblies of the form shown in FIG. 9A, moving the cam adjustment portion to reduce the lift also reduces the wedging by wedges 258, 256 against the band 150 to thereby adjust the timing. More specifically, this movement of the cam adjustment portion to reduce the lift shifts the location 2*c* to begin later and the location 2*d* to occur earlier in the rotation of the cam assembly. In one specific embodiment, the valve lift can be more than 10 millimeters, such as 11 millimeters from a zero lift or engine stop position, with 0.2 millimeters lift corresponding to an engine idle position. In addition, in one example, the valves can be open for up to 300 degrees of the crank shaft rotation with the valves being open, for example, for 90 degrees for engine idle and zero degrees for engine stop. The engine stop position can correspond to the cam adjustment portion 100 being fully collapsed into the cam body to provide zero lift. The extent of lift can be established by the eccentricity of the eccentric 88 or the height of a wedge if an axially shiftable wedge actuator is used. The variation of the timing can be changed by adjusting the configuration of the wedges and wedging surfaces.

With this construction, when used for a gasoline fueled internal combustion engine, the use of an engine throttle can be eliminated.

As previously mentioned, the valves 360, 360' comprise air intake valves. A separate valve actuating shaft and cam assemblies, which can be identical to those previously described, can be used to control the operation of one or more exhaust valves associated with a cylinder. A cam assembly can be used to control more than one exhaust valve such as explained above in connection with the intake valves.

Figure 14:
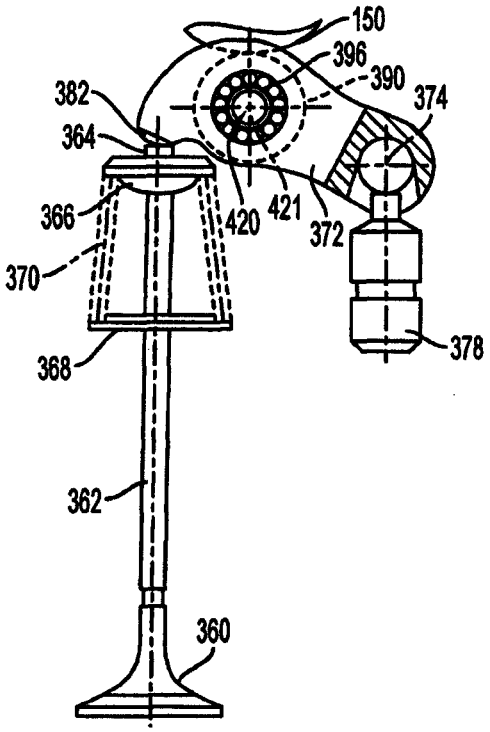
FIG. 14 illustrates an alternative embodiment of a cam assembly with variable valve lift and timing shown in combination with a rocker arm and first and second valves, although only one such valve is visible in FIG. 14.
Figure 14A:
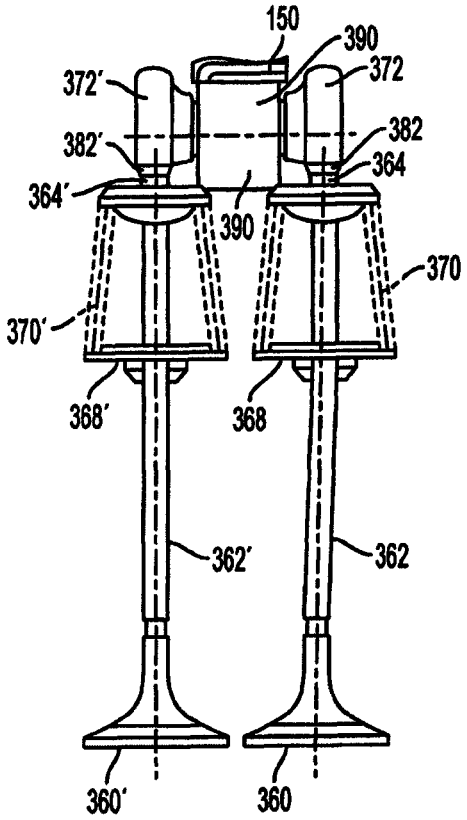
FIG. 14A is a front view of the assembly of FIG. 14.
Figure 14B:
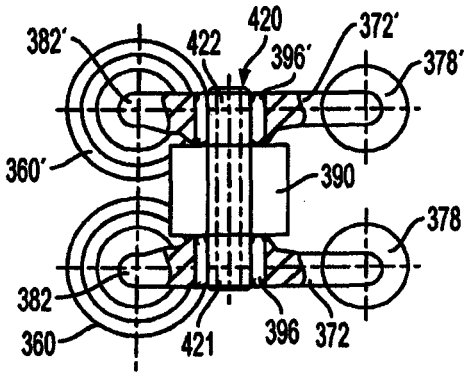
FIG. 14B is a top view of the valve assembly of FIG. 14.

The mechanisms of FIGS. 14, 14A and 14B are like those shown in FIGS. 13, 13A and 13B, consequently, like components have been assigned like numbers in FIGS. 14, 14A and 14B and will not be discussed in detail. In the embodiment of FIGS. 14, 14A and 14B, a roller 390 is coupled to a pin 420 extending through the roller. Bearings, such as needle bearings, rotatably couple a first end 421 of pin 420 to the rocker arm 372. In addition, bearings, such as needle bearings 396', couple a second end 422 of pin 420 to the rocker arm 372' to thereby rotatably couple pin end 422 to this rocker arm. As a result of this coupling, roller 390 is rotatable relative to each of the rocker arms 372, 372'.

Figure 15:
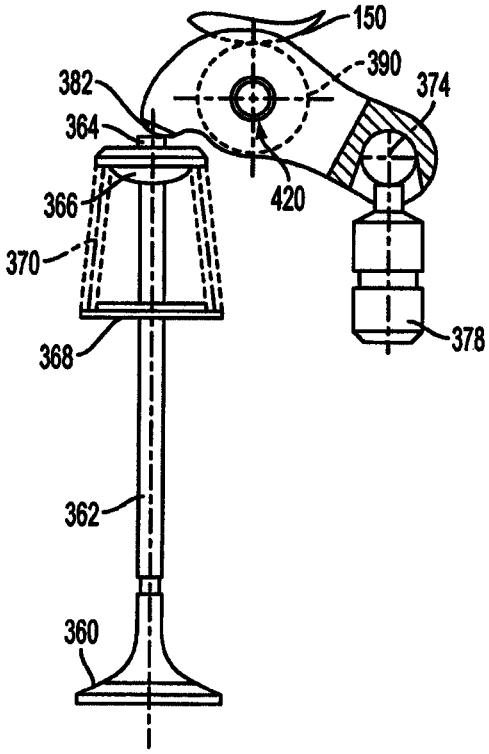
FIG. 15 illustrates yet another embodiment of a cam assembly with variable valve lift and timing shown in combination with a rocker arm and first and second valves, although only one such valve is visible in FIG. 15.
Figure 15A:
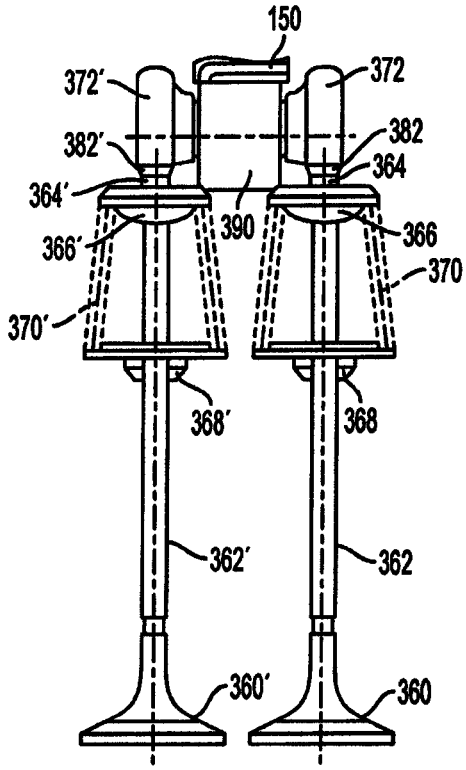
FIG. 15A is a front view of the assembly of FIG. 15.
Figure 15B:
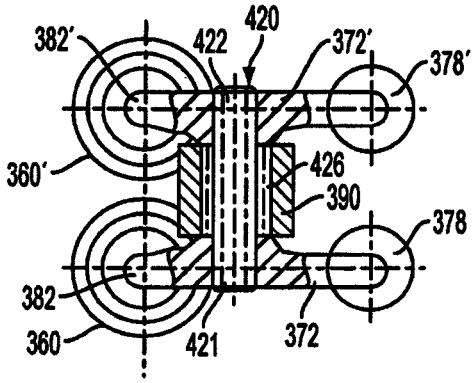
FIG. 15B is a top view of the valve assembly of FIG. 15.

In the embodiment of FIGS. 15, 15A and 15B, components that are like those shown in the embodiments of FIGS. 13, 13A and 13B have been assigned the same numbers and will not be discussed in detail. In the embodiment of FIGS. 15, 15A and 15B, the bearings 396, 396' have been eliminated. Instead, as best seen in FIG. 15B, the roller 390 is coupled by bearings 426, such as needle bearings, to the pin 420. In addition, the end 421 of pin 420 is coupled to rocker arm 372. Also, the pin end 422 is coupled to the rocker arm 372'. The pin 422 is loosely coupled to one or both of the rocker arms in this embodiment. In this construction, the roller 390 is rotatable relative to pin 420 and thus relative to the rocker arms.

It should be noted that utilizing a single cam assembly coupled to two or more rocker arms to operate plural valves, each valve being operated by a respective associated rocker arm is unique independently of whether a valve lift adjustment mechanism and/or a valve timing mechanism in accordance with this disclosure is used.

The invention disclosed herein includes all novel and non-obvious combinations and sub-combinations of elements and individual elements set forth herein as well as novel and non-obvious method acts described herein. The embodiments disclosed herein are examples and are not to be construed as limiting the scope of this disclosure. There is no requirement that a particular novel and non-obvious sub-combination of elements include all features of a particular embodiment disclosed herein nor is there any requirement that the particular embodiment have all the advantages of the various embodiments disclosed herein.

Having illustrated and described the principles of my invention with reference to a number of embodiments, it should be apparent to those of ordinary skill in the art that these embodiments may be modified in arrangement and detail without departing from the inventive concepts, features and method acts disclosed herein. I claim all such modifications as fall within the scope of the following claims.

I claim:

1. An apparatus for opening and closing one or more cylinder valves of an internal combustion engine comprising:

a valve actuating shaft having a longitudinal shaft axis;

at least one cam assembly positioned along the length of the shaft such that rotation of the shaft about the shaft axis rotates the cam assembly, the cam assembly comprising a cam body portion and a cam adjustment portion, the cam adjustment portion being coupled to the cam body portion for movement in a first direction outwardly from the cam body portion to increase the distance around the cam body portion and cam adjustment portion and for movement in a second direction inwardly toward the cam body to reduce the distance around the cam body portion and cam adjustment portion;

a cam actuator coupled to the cam adjustment portion and positioned within the valve actuating shaft, the cam actuator being operable such that movement of the cam actuator in one direction moves the cam adjustment portion in the first direction and movement of the cam actuator in another direction allows the movement of the cam adjustment portion in the second direction;

the cam assembly comprising a band comprising at least one spring portion of an expandable and retractable length, the band surrounding the cam body portion and cam adjustment portion, the spring portion expanding in length in response to the movement of the cam adjustment portion in the first direction and contracting in length in response to the movement of the cam adjustment portion in the second direction;

the cam body portion further comprising at least first and second wedging surfaces that at least partially underlay and face the band, the first wedging surface leading in the direction of rotation of the cam assembly and the second wedging surface lagging in the direction of rotation of the cam assembly;

the cam assembly comprising a first wedge coupled to the cam adjustment portion and positioned at least partially between the first wedging surface and the band, the cam assembly also comprising a second wedge coupled to the cam adjustment portion and positioned at least partially between the second wedge surface and the band, the first and second wedges being movable with the movement of the cam adjustment portion in the first and second directions;

the first wedge and first wedging surface and the second wedge and second wedging surface being configured to adjust the shape of the band to cause the opening of the valve to commence earlier in the rotational position of the cam assembly with the movement of the cam adjustment portion in the first direction and to cause the opening of the one or more valves to commence later in the rotational position of the cam assembly with the movement of the cam adjustment portion in the second direction; and a valve actuator coupled to the cam assembly and operable to open and close one or more cylinder valves as the cam assembly rotates.

2. An apparatus according to claim 1 wherein the cam adjustment portion comprises an arcuate band engaging exterior surface positioned to engage the band and a projecting member extending in a direction away from the band engaging exterior surface, the cam body portion defining a projecting member receiving opening that slidably receives the projecting member, the projecting member being coupled to the cam actuator, wherein movement of the cam actuator in said one direction applies an outward force to the projecting member to urge the cam adjustment portion and thereby the band engaging exterior surface in the first direction; and movement of the cam actuator in said another direction allows the band to contract to urge the cam adjustment portion and thereby the band engaging exterior surface in the second direction.

3. An apparatus according to claim 1 wherein the cam actuator comprises an eccentric positioned within the valve actuator shaft to engage the cam adjustment portion to move the cam adjustment portion in the first direction upon rotation of the eccentric in one rotational direction and to allow movement of the cam adjustment portion in the second direction upon rotation of the eccentric portion in a rotational direction opposite to said one direction.

4. An apparatus according to claim 1 wherein the cam actuator comprises a camming wedge movable axially within the valve actuating shaft, the camming wedge being coupled to the cam adjustment portion such that sliding of the camming wedge axially in one wedge sliding direction causes the cam adjustment portion to move in the first direction and sliding the wedge axially in a direction opposite to said one wedge sliding direction allows the cam adjustment portion to move in the second direction.

5. An apparatus according to claim 2 wherein the spring portion applies a retraction force to the exterior surface of the cam adjustment portion to urge the cam adjustment portion in the second direction.

6. An apparatus according to claim 1 wherein the cam adjustment portion comprises a recess that opens toward the band and wherein the band has a band projection shaped and positioned within the recess.

7. An apparatus according to claim 1 wherein the spring band has first and second band end portions and a central band portion and wherein the central band portion is thicker than the thickness of the first and second band end portions.

8. An apparatus according to claim 1 wherein the band comprises a body portion and at least one spring portion extending from the body portion.

9. An apparatus according to claim 8 wherein the body portion and spring portion are one piece.

10. An apparatus according to claim 8 wherein the body has first and second end portions and the band comprises a first spring portion extending from the first end portion of the body and a second spring portion extending from the second end portion of the body.

11. An apparatus according to claim 8 wherein the spring portion is detachable from the body portion.

12. An apparatus according to claim 1 wherein the band comprises a body with first and second distal end portions, the first and second distal end portions of the body being configured to engage one another to hold the distal end portions of the spring band together, and wherein the band comprises at least one serpentine band section that expands with the movement of the cam adjustment portion in the first direction and contracts with the movement of the cam adjustment portion in the second direction.

13. An apparatus according to claim 12 wherein the band comprises first and second serpentine end portions and a central portion, wherein the band comprises a band projection extending inwardly toward the cam adjustment surface, wherein the cam adjustment surface comprises a recess configured and positioned to receive the band projection.

14. An apparatus according to claim 1 wherein each of the first and second wedges are of an elongated arcuate shape.

15. An apparatus according to claim 1 wherein each of the first and second wedges have a wedging angle that is different.

16. An apparatus according to claim 1 wherein in cross-section each of the wedges comprises a tip portion positioned adjacent to the cam adjustment portion that is of an acute shape and a base portion spaced from the cam adjustment portion that is of a rounded shape.

17. An apparatus according to claim 1 wherein upon movement of the cam adjustment surface in the second direction to its furthest retracted position, a first gap is provided between the first wedge and first wedging surface and a second gap is provided between the second wedge and second wedging surface, the first and second gaps being positioned adjacent to the base portion of the respective first and second wedges, and wherein movement of the cam adjustment portion in the first direction causes the first wedging surface to push the first wedge outwardly to push the band outwardly and causes the second wedging surface to push the second wedge outwardly to push the spring band outwardly so as to change the timing of the commencement of the opening and closing of the valve.

18. An apparatus according to claim 1 wherein the first and second wedging surfaces are curved.

19. An apparatus according to claim 13 wherein the first and second wedging surfaces comprise respective surface portions that are of a spiral configuration.

20. An apparatus according to claim 1 wherein there are two of said first wedge surfaces with one of the first wedge surfaces being positioned axially along the valve actuating shaft adjacent to one side of the cam adjustment portion and the other of the first wedge surfaces being positioned axially along the valve actuating shaft adjacent to the other side of the cam adjustment portion, there are two of said second wedge surfaces with one of the second wedge surfaces being positioned along the valve actuating shaft adjacent to one side of the cam adjustment portion and the other of the second wedge surfaces being positioned axially along the valve actuating shaft adjacent to the other side of the cam adjustment portion, the apparatus comprising a wedge assembly comprising a wedge base comprising first and second side edge portions, a first set of wedges comprising one first wedge and one second wedge being mounted to the wedge base along the first side edge portion of the wedge base, a second set of wedges comprising another first wedge and another second wedge mounted to the wedge base along the second side edge portion of the wedge base, the wedge assembly being positioned such that the first set of first and second wedges are positioned to face the respective first and second wedge surfaces adjacent to said one side of the cam adjustment portion and the second set of the first and second wedges being positioned to face the first and second wedge surfaces and are adjacent to said other side of the cam adjustment portion, and wherein the base comprises a central portion positioned at least partially between the band and the cam adjustment portion.

21. An apparatus according to claim 20 wherein the cam adjustment portion comprises a cam adjustment portion recess facing the spring band and extending across the cam adjustment portion in a direction parallel to the shaft axis, the wedge base comprising a wedge assembly projection sized and positioned to fit within the cam adjustment portion recess, the wedge base comprising a wedge assembly recess facing the spring band and extending in a direction parallel to the shaft axis, the spring band comprising an interior band projection positioned, sized and configured to fit within the wedge assembly recess.

22. An apparatus according to claim 1 comprising at least one valve, the valve actuator comprising a rocker arm coupled to the valve, the cam assembly being positioned to engage the rocker arm such that the cam assembly shifts the rocker arm to open and close the valve as the cam assembly is rotated.

23. An apparatus according to claim 22 wherein the valve actuator comprises first and second rocker arms, there being first and second valves associated with a cylinder with each valve being operably coupled to a respective one of the rocker arms, a roller extending between said first and second rocker arms, the cam assembly being positioned to engage the roller such that as the cam assembly rotates, the first and second rocker arms simultaneously operate the first and second valves.

24. An apparatus according to claim 23 further comprising a pin coupled to the first and second rocker arms and defining a pin axis, a needle bearing supported by the pin and the roller being pivoted by the needle bearing to the pin for rotation about the pin axis.

25. An apparatus according to claim 23 wherein the roller comprises respective first and second end portions, a first needle bearing coupling the first end portion of the roller to the first rocker arm and a second needle bearing coupling the second end portion of the roller to the second rocker arm, and wherein the roller is rotatable relative to the rocker arms.

26. An apparatus according to claim 1 in combination with a gasoline fueled engine comprising a plurality of valves operated by cam assemblies in accordance with claim 1.

27. An apparatus according to claim 26 wherein the gasoline fueled engine lacks an inlet air throttle.

28. An apparatus according to claim 1 in combination with a diesel fueled engine comprising a plurality of valves operated by cam assemblies in accordance with claim 1.

29. An apparatus according to claim 1 wherein the cam assembly comprises a first base circuit portion, a first ramp portion, a first flank portion, a first top portion, a second top portion, a second flank portion, a second ramp portion and a second base circuit portion, the first and second base portions being continuous and having a circular periphery, the first and second top portions also being continuous, the first ramp portion being between the first base portion and first flank portion and the first flank portion being between the first ramp portion and first top portion, the second ramp portion being between the second base portion and second flank portion and the second flank portion being between the second ramp portion and the second top portion, the valve actuator comprising a roller, the first and second base circuit portions being defined by a portion of the cam body that engages the roller as the cam assembly rotates, the first and second top portions comprising a portion of the band that engages the roller as the cam assembly rotates when the cam adjustment portion is shifted outwardly in the first direction from the cam body.

30. An apparatus according to claim 29 wherein the at least one spring portion of the band is recessed into the base circuit defining portion of the cam body such that the spring portion does not engage the roller as the cam assembly rotates.

31. An apparatus according to claim 29 wherein the cam body defines at least one right cylindrical engagement surface that is positioned to continuously engage the roller as the cam assembly rotates at least when the cam adjustment portion is in its furthest inward position.

32. An apparatus for opening and closing one or more cylinder valves of an internal combustion engine comprising:

a valve actuating shaft having a longitudinal shaft axis;

at least one cam assembly positioned along the length of the shaft such that rotation of the shaft about the shaft axis rotates the cam assembly, the cam assembly comprising a cam body portion and a cam adjustment portion, the cam adjustment portion being coupled to the cam body portion for movement in a first direction outwardly from the cam body portion to increase the distance around the cam body portion and cam adjustment portion and for movement in a second direction inwardly toward the cam body to reduce the distance around the cam body portion and cam adjustment portion;

a cam actuator coupled to the cam adjustment portion and positioned within the valve actuating shaft, the cam actuator being operable such that movement of the cam actuator in one direction moves the cam adjustment portion in the first direction and movement of the cam actuator in another direction allows the movement of the cam adjustment portion in the second direction;

the cam assembly comprising a surround comprising at least one portion that is configured to be expandable and retractable in length, the surround surrounding the cam body portion and cam adjustment portion, said at least one portion of the surround expanding in length in response to the movement of the cam adjustment portion in the first direction and contracting in length in response to the movement of the cam adjustment portion in the second direction; and a valve actuator coupled to the cam assembly and operable to open and close one or more cylinder valves as the cam assembly rotates.

33. An apparatus according to claim 32 wherein the surround comprises a band, the cam adjustment portion comprises an arcuate band engaging exterior surface positioned to engage the band and a projecting member extending in a direction away from the band engaging exterior surface, the cam body portion defining a projecting member receiving opening that slidably receives the projecting member, the projecting member being coupled to the cam actuator, wherein movement of the cam actuator in said one direction applies an outward force to the projecting member to urge the cam adjustment portion and thereby the band engaging exterior surface in the first direction; and movement of the cam actuator in said another direction allows the spring band to contract to urge the cam adjustment portion and thereby the band engaging exterior surface in the second direction.

34. An apparatus according to claim 32 wherein the cam actuator comprises an eccentric positioned within the valve actuator shaft to engage the cam adjustment portion to move the cam adjustment portion in the first direction upon rotation of the eccentric in one rotational direction and to allow movement of the cam adjustment portion in the second direction upon rotation of the eccentric portion in a rotational direction opposite to said one direction.

35. An apparatus according to claim 32 wherein the cam actuator comprises a camming wedge movable axially within the valve actuating shaft, the camming wedge being coupled to the cam adjustment portion such that sliding of the camming wedge axially in one wedge sliding direction causes the cam adjustment portion to move in the first direction and sliding the wedge axially in a direction opposite to said one wedge sliding direction allows the cam adjustment portion to move in the second direction.

36. An apparatus according to claim 32 wherein the surround comprises a band, wherein the cam adjustment portion comprises a recess that opens toward the band and wherein the band, has a band projection shaped and positioned within the recess.

37. An apparatus according to claim 32 wherein the surround comprises a band, wherein the band has first and second band end portions and a central band portion and wherein the central band portion is thicker than the thickness of the first and second band end portions.

38. An apparatus according to claim 32 wherein the surround comprises a band, wherein the band comprises a body with first and second distal end portions, the first and second distal end portions of the body being configured to engage one another to hold the distal end portions of the band together, and wherein the band comprises at least one serpentine band section that expands with the movement of the cam adjustment portion in the first direction and contracts with the movement of the cam adjustment portion in the second direction.

39. An apparatus according to claim 32 wherein the surround comprises a band, wherein the band comprises first and second serpentine end portions and a central portion, wherein the band comprises a band projection extending inwardly toward the cam adjustment surface, wherein the cam adjustment surface comprises a recess configured and positioned to receive the band projection.

40. An apparatus according to claim 32 comprising at least one valve, the valve actuator comprising a rocker arm coupled to the valve, the cam assembly being positioned to engage the rocker arm such that the cam assembly shifts the rocker arm to open and close the valve as the cam assembly is rotated.

41. An apparatus according to claim 40 wherein the valve actuator comprises first and second rocker arms, there being first and second valves associated with a cylinder with each valve being operably coupled to a respective one of the rocker arms, a roller extending between said first and second rocker arms, the cam assembly being positioned to engage the roller such that as the cam assembly rotates the first and second rocker arms simultaneously operates the first and second valves.

42. An apparatus according to claim 41 further comprising a pin coupled to the first and second rocker arms and defining a pin axis, and a needle bearing supported by the pin and the roller being pivoted by the needle bearing to the pin for rotation about the pin axis.

43. An apparatus according to claim 41 wherein the roller comprises respective first and second end portions, a first needle bearing coupling the first end portion of the roller to the first rocker arm and a second needle bearing coupling the second end portion of the roller to the second rocker arm, and wherein the roller is rotatable relative to the rocker arms.

* * * * *